US008089210B2

(12) United States Patent
Shinohe et al.

(10) Patent No.: US 8,089,210 B2
(45) Date of Patent: Jan. 3, 2012

(54) PLASMA TUBE ARRAY-TYPE DISPLAY SUB-MODULE AND DISPLAY DEVICE

(75) Inventors: Koji Shinohe, Kobe (JP); Takamitsu Bunno, Kobe (JP); Yoshio Shibukawa, Kobe (JP); Bingang Guo, Kobe (JP); Naganori Tsutsui, Kobe (JP); Hitoshi Hirakawa, Kobe (JP); Kenji Awamoto, Kobe (JP)

(73) Assignee: Shinoda Plasma Co., Ltd., Kobe-Shi (JP)

( * ) Notice: Subject to any disclaimer, the term of this patent is extended or adjusted under 35 U.S.C. 154(b) by 230 days.

(21) Appl. No.: 12/485,987

(22) Filed: Jun. 17, 2009

(65) Prior Publication Data

US 2009/0315441 A1 Dec. 24, 2009

(30) Foreign Application Priority Data

Jun. 20, 2008 (JP) ..... 2008-161239
Apr. 21, 2009 (JP) ..... 2009-102715

(51) Int. Cl.
*H01J 17/49* (2006.01)

(52) U.S. Cl. ..... 313/582; 313/587; 313/292

(58) Field of Classification Search ..... 313/582–587, 313/292, 609

See application file for complete search history.

(56) References Cited

U.S. PATENT DOCUMENTS

2006/0082272 A1* 4/2006 Kim et al. ..... 313/46
2007/0007877 A1* 1/2007 Ishimoto et al. ..... 313/488
2007/0052621 A1* 3/2007 Hirakawa et al. ..... 345/60
2008/0079346 A1* 4/2008 Ishimoto et al. ..... 313/487
2008/0297447 A1* 12/2008 Awamoto et al. ..... 345/60
2009/0058768 A1* 3/2009 Ishimoto et al. ..... 345/60
2009/0273273 A1* 11/2009 Guo et al. ..... 313/493
2009/0278437 A1* 11/2009 Yamazaki et al. ..... 313/485
2009/0284448 A1* 11/2009 Tamura et al. ..... 345/60
2009/0310343 A1* 12/2009 Shibukawa et al. ..... 362/225
2009/0315809 A1* 12/2009 Shibukawa et al. ..... 345/1.3
2010/0231486 A1* 9/2010 Awamoto et al. ..... 345/66

FOREIGN PATENT DOCUMENTS

JP 2003-043937 2/2003
JP 2003-338245 11/2003

* cited by examiner

*Primary Examiner* — Joseph L Williams
*Assistant Examiner* — Kevin Quarterman
(74) *Attorney, Agent, or Firm* — Staas & Halsey LLP

(57) ABSTRACT

This invention provides a plasma tube array-type display sub-module capable of reducing a possibility of occurrence of troubles on a plasma tube array during a manufacturing process even in a case where irregularities are formed on the back side of the plasma tube array, and a display device. The plasma tube array-type display sub-module comprises a plasma tube array including a plurality of plasma tubes arranged in parallel, the plasma tube array being held between an address electrode support sheet having address electrodes formed thereon and a display electrode support sheet having display electrodes formed thereon, wherein the plasma tube array is fixed to a sub-module frame through an intermediate layer that is made of a material more flexible than that of the plasma tube array and can deform along the irregularities on the address electrode support sheet of the plasma tube array.

13 Claims, 13 Drawing Sheets

PLASMA TUBE ARRAY-TYPE DISPLAY SUB-MODULE AND DISPLAY DEVICE

CROSS-REFERENCE TO RELATED APPLICATIONS

This application claims priority to and the benefit of Japanese Application Ser. No. 2008-161239 which was filed Jun. 20, 2008, entitled Plasma Tube Array-Type Display Sub-Module and Display Device, and Japanese Application Ser. No. 2009-102715 which was filed Apr. 21, 2009, entitled Plasma Tube Array-Type Display Sub-Module and Display Device, the entirety of each being hereby incorporated by reference as if fully set forth herein.

BACKGROUND OF THE INVENTION

1. Field of the Invention

The present invention relates to a plasma tube array-type display sub-module comprising a plasma tube array having a plurality of plasma tubes arranged in parallel, and a display device. More specifically, the present invention relates to a plasma tube array-type display sub-module which can be attached reliably to a sub-module frame without causing any troubles on a plasma tube array even in a case where an address electrode support sheet on the back side of the plasma tube array has irregularities, and a display device.

2. Description of the Related Art

As a technology for realizing a next-generation large-screen display device, a plasma tube array-type display sub-module has been developed with a structure that a plurality of plasma tubes each filled with a discharge gas is arranged in parallel. For example, a large-screen display device having a scale of several meters by several meters in size can be constructed of a plasma tube array-type display system module that a plurality of plasma tube array-type display sub-modules of one square-meter in size is joined to one another. The display device of such a type that the plurality of plasma tube array-type display sub-modules is joined to one another does not need either a large glass substrate to be handled, like an LCD, a PDP and the like, nor a large-scale facility and achieves even image quality at low cost.

Typically, a large-screen plasma tube array-type display device can be constructed as follows. That is, a plasma tube array-type display sub-module is prepared in such a manner that a plasma tube array is integrated with a structural body called a sub-module frame of a certain size. Then, the plurality of plasma tube array-type display sub-modules is joined to one another. Herein, the "plasma tube array-type display sub-module" refers to a display film component as described above which includes a plasma tube, that is, a semi-finished product of a display panel, which dos not have a drive circuit, a power supply circuit and the like incorporated. FIGS. 1A to 1C are perspective views each of which shows a schematic configuration of a plasma tube array of a conventional plasma tube array-type display sub-module. More specifically, FIG. 1A is a perspective view schematically showing the configuration of the plasma tube array of the plasma tube array-type display sub-module. FIG. 1B is a perspective view partly showing the configuration of the plasma tube array of the plasma tube array-type display sub-module. FIG. 1C is a perspective view showing a state that the plasma tube array-type display sub-modules are joined vertically and horizontally to one another.

As shown in FIG. 1A, a conventional plasma tube array-type display sub-module 30 has a rectangular shape as it comprises a part of a rectangular screen and a plurality of plasma tubes 31, 31, . . . each filled with a discharge gas is arranged in parallel. The plasma tube 31 is a discharging thin tube made of glass, which diameter is not particularly limited, but preferably about 0.5 to 5 mm. Herein, for example, the plasma tube array-type display sub-module 30 of one square-meter in size is constructed in such a manner that 1000 pieces of glass thin tubes each having a diameter of 1 mm, a length of 1 m and an oblate ellipsoid section are arranged in parallel by a set of several pieces. The section of the thin tube is not particularly limited in shape, and examples thereof may include a circular section, an oblate ellipsoid section, a square section and the like. Moreover, the plasma tube 31 is filled with a discharge gas such as neon, xenon and the like at a predetermined ratio at a predetermined pressure.

The plurality of plasma tubes 31, 31, . . . arranged in parallel is held between a back-side address electrode support sheet 33, which comprises a plurality of address electrodes 32, 32, . . . formed thereon so as to be in contact with the lower side of the plasma tubes 31, 31, . . . in the longitudinal direction of the plasma tubes 31, 31, . . . , and a front-side display electrode support sheet 35, which comprises a plurality of display electrodes 34, 34, . . . formed thereon so as to cross the upper side of the plasma tubes 31, 31, . . . in the direction orthogonal to the longitudinal direction of the plasma tubes 31, 31, . . . . Herein, the display electrode support sheet 35 is a flexible sheet made of, for example, a polycarbonate film, a PET (polyethylene terephthalate) film or the like.

The plurality of display electrodes 34, 34, . . . is formed in stripes on the inner surface of the display electrode support sheet 35 so as to be contact with the plasma tubes 31, 31, . . . and to cross the upper side of the plasma tubes 31, 31, . . . . The plurality of adjacent display electrodes 34, 34 forming a display electrode pair functions as an X electrode and a Y electrode. Display discharge occurs inside the plasma tubes 31, 31, . . . located between the X electrode and the Y electrode. In addition to the stripe pattern, the pattern of the display electrodes 34, 34, . . . may be a pattern which is publicly known in the relevant technical field, and examples thereof may include a mesh pattern, a ladder pattern, a comb pattern and the like. Moreover, examples of the material for the display electrode 34 may include transparent conductive materials such as ITO (Indium Tin Oxide) and $SnO_2$, and metal conductive materials such as Ag, Au, Al, Cu and Cr and the like.

The display electrode 34 can be formed by various methods which are publicly known in the relevant technical field. For example, the display electrode 34 may be formed by using a thick film technology, such as a printing, or by using a thin film technology such as a physical deposition method or a chemical deposition method. Examples of the thick film technology may include a screen print method and the like. With regard to the thin film technology, examples of the physical deposition method may include an evaporation method, a sputtering method and the like whereas examples of the chemical deposition method may include a thermal CVD method, a photo CVD method, a plasma CVD method and the like.

The plurality of address electrodes 32, 32, . . . is formed on the back side of the plasma tube array-type display sub-module 30 per plasma tube 31 along the longitudinal direction of the plasma tubes 31, 31, . . . , wherein an emit light cell is formed at an intersection of the address electrode 32 and the paired display electrode 34. The address electrode 32 can be formed by various materials and methods which are publicly known in the relevant technical field.

In the configuration described above, as shown in FIG. 1B, the plasma tube array-type display sub-module 30 achieves color display in such a manner that each plasma tube 31 comprises a single-color phosphor layer 36. Examples of the phosphor layers 36, 36, . . . comprise a red (R) phosphor layer 36R, a green (G) phosphor layer 36G and a blue (B) phosphor layer 36B. A set of the plasma tube 31 comprising the red (R) phosphor layer 36R, the plasma tube 31 comprising the green (G) phosphor layer 36G and the plasma tube 31 comprising the blue (B) phosphor layer 36B forms one pixel, so that the plasma tube array-type display sub-module 30 can achieve color display. Herein, the red (R) phosphor layer 36R is made of a phosphor material such as $(Y,Gd)BO_3:EU^{3+}$ in order to emit red light by irradiation with ultraviolet rays. The green (G) phosphor layer 36G is made of a phosphor material such as $Zn_2SiO_4$:Mn in order to emit green light by irradiation with ultraviolet rays. The blue (B) phosphor layer 36B is made of a phosphor material such as $BaMgAl_{12}O_{17}:Eu^{2+}$ in order to emit blue light by irradiation with ultraviolet rays. In order to enhance flexibility of the plasma tube array-type display sub-module 30 and facilitate the assembly thereof, preferably, a plasma tube unit is prepared in such a manner that the plurality of the set of the three plasma tubes for three colors R, G, B is attached to the reed-shaped back-side address electrode support sheet 33 in parallel, and then the plurality of plasma tube units is attached to the front-side display electrode support sheet 35, so that the plasma tube array-type display sub-module 30 for a color display is fabricated.

The perspective view in FIG. 1C schematically shows a plasma tube array-type display system module 45 that the plurality of plasma tube array-type display sub-modules 30, 30, . . . is joined vertically and horizontally to one another. As shown in FIG. 1C, herein, four pieces of plasma tube array-type display sub-modules 30, 30, . . . construct one plasma tube array-type display system module 45 for a large screen. Each plasma tube array-type display sub-module 30 is a semi-finished product which does not have a drive circuit, a power supply circuit and the like incorporated. After construction of the large-screen plasma tube array-type display system module 45, a drive circuit, a power supply circuit and the like are incorporated in the plasma tube array-type display system module 45 defining the whole system module as one display film. Thus, a large-screen display device can be constructed, which has a feature suppressing a variation in quality of images displayed on the respective plasma tube array-type display sub-modules 30, 30, . . . . The plasma tube array-type display sub-modules 30, 30 joined horizontally to each other can be driven simultaneously by connecting the display electrodes 34, 34 in the connection structure according to the present invention. For the plasma tube array-type display sub-modules 30, 30 joined vertically to each other, the respective address electrodes 32, 32 are lead to the upper side and the lower side of the screen so as to be connected to an address drive circuit, whereby the screens of the upper two plasma tube array-type display sub-modules 30, 30 and the screens of the lower two plasma tube array-type display sub-modules 30, 30 can be simultaneously driven by a publicly known method, so-called dual scan technique without connecting the respective address electrodes 32, 32.

As described above, the plasma tube array itself is configured such that the plurality of plasma tubes 31, 31, . . . is held between the address electrode support sheet 33 which is a flexible sheet and the display electrode support sheet 35. Therefore, it is difficult to keep the shape of the plasma tubes 31, 31, . . . , under such a condition. Accordingly, in general, the plasma tube array is attached to the structural body called a sub-module frame to form the plasma tube array-type display sub-module 30, and the plurality of plasma tube array-type display sub-modules 30, 30, . . . is joined to one another to form a display panel for a large-screen display device.

However, the address electrode support sheet 33 on the back side of the plasma tube array might have deformation such as distortion, warpage and the like and the irregularities caused by a projection (burr) on a cutting surface generated upon cutting. Moreover, since a production error is generated on the plasma tube 31 itself, the size such as the diameter is non-constant. Therefore, when the plasma tube array is held between the address electrode support sheet 33 and the display electrode support sheet 35, irregularities might also be generated on the display electrode support sheet 35.

When the plasma tube array is attached to a flat sub-module frame, called a support plate, with such irregularities generated, the back side of the plasma tube array is forced to be flattened on the surface of the sub-module frame, which causes a stress and the like to arise problems of the deformation of the plasma tube array, generation of residual stress, separation of the address electrode support sheet 33 or the display electrode support sheet 35 from the plasma tube array, and the like.

Since the plurality of plasma tubes 31, 31, . . . is arranged in parallel, the shape of each plasma tube 31 slightly varies due to the pressure variation or temperature change inside the plasma tube 31, when a drive voltage is applied thereto. Moreover, the production precision itself varies for each plasma tube 31, wherein the size, i.e., the diameter, of each the plasma tube 31 varies. These factors are correlated with each other, resulting in that, depending upon a drive input pattern, resonance occurs with a vibration mode specific to the plasma tube array, and therefore, an abnormal noise is generated from the surface of the plasma tube array.

In order to avoid the abnormal noise leaking from the front side of the display device, a noise insulation film with a noise insulating effect has to be provided on the front side of the display screen. For example, JP 2003-043937 A discloses a display filter (film) aiming to ease shock of a plasma display. This filter can ease the external shock, but JP 2003-043937 A does not disclose nor suggest the function to avoid the abnormal noise, which is generated from the inside, leaking to the outside.

SUMMARY OF THE INVENTION

The present invention has been devised in view of the circumstances described above, and an object thereof is to provide a plasma tube array-type display sub-module and a display device, which can reduce a possibility of causing any troubles on a plasma tube array during a manufacturing process even in a case where an address electrode support sheet on the back side of the plasma tube array has irregularities.

Another object of the present invention is to provide a display device which can effectively avoid an abnormal noise, which is generated from the surface of the plasma tube array, leaking from the front side of the display device.

In order to accomplish the objects described above, a first aspect of the present invention is directed to a plasma tube array-type display sub-module comprising an address electrode support sheet having a plurality of address electrodes formed thereon, a display electrode support sheet having a plurality of display electrodes formed thereon, and a plurality of plasma tubes each filled with a discharge gas, arranged in parallel and held between the address electrode support sheet and the display electrode support sheet, wherein the plasma tube array is fixed to a sub-module frame through an intermediate layer which can deform along the surface shape of the address electrode support sheet on the back side.

According to the first aspect of the present invention, the plasma tube array is fixed to the sub-module frame through the intermediate layer that can deform along the surface shape of the address electrode support sheet on the back side. Since the intermediate layer can deform along the surface shape of the address electrode support sheet on the back side so as to support the plasma tube array in any surface shape on the back side, residual stress is not caused on the plasma tube array, whereby it can be prevented that the irregularities are generated on the surface of the display electrode support sheet on the front side.

A second aspect of the present invention is directed to the plasma tube array-type display sub-module according to the first aspect of the present invention, wherein an adhesive layer that bonds the address electrode support sheet to the plasma tubes is a solvent type adhesive layer, and the adhesive layer bonds the address electrode support sheet to the plasma tubes at the position where the adhesive layer is not in contact with the intermediate layer.

According to the second aspect of the present invention, the adhesive layer that bonds the address electrode support sheet to the plasma tubes is a solvent type adhesive layer. Therefore, when the intermediate layer and the adhesive layer are brought into contact with each other, especially in the case that a solvent type acrylic resin is used for both the adhesive layer and the intermediate layer, a chemical reaction occurs, whereby both layers may be dissolved. In view of this, the address electrode support sheet and the plasma tubes are bonded at the position where the adhesive layer is not in contact with the intermediate layer. With this structure, there is no possibility of the contact between the adhesive layer, which bonds the address electrode support sheet and the plasma tubes, and the intermediate layer. Further, the thickness of the intermediate layer can be reduced. Therefore, the plasma tube array-type display sub-module constituting a thin display device can be provided of high quality.

A third aspect of the present invention is directed to the plasma tube array-type display sub-module according to the first aspect of the present invention, wherein the intermediate layer is formed so as to be in contact with a first adhesive layer, which bonds the address electrode support sheet that is divided by the plurality of plasma tubes and the plasma tubes, and a second adhesive layer, which bonds the display electrode support sheet and the plasma tubes, through a gap between the adjacent address electrode support sheets and a clearance between the adjacent plasma tubes.

According to the third aspect of the present invention, even when the intermediate layer is brought into contact with the first adhesive layer which bonds the address electrode support sheet that is divided by the plurality of plasma tubes and the plasma tubes and the second adhesive layer which bonds the display electrode support sheet and the plasma tubes, through the gap between the adjacent address electrode support sheets and the clearance between the adjacent plasma tubes, a chemical reaction does not occur between them, so that the plasma tube array can be fixed to the sub-module frame without deteriorating the quality of the plasma tube array. Since the intermediate layer can support each of the plasma tubes so as to fix it at a predetermined position, the generation of a specific abnormal noise, due to the vibration of the plasma tubes, can be prevented.

A fourth aspect of the present invention is directed to the plasma tube array-type display sub-module according to the first aspect of the present invention, wherein the intermediate layer is formed so as to be in contact with a first adhesive layer, which bonds the address electrode support sheet that is divided by the plurality of plasma tubes and the plasma tubes, through a gap between the address electrode support sheets and a clearance between the adjacent plasma tubes, and a second adhesive layer, which bonds the display electrode support sheet and the plasma tubes, bonds the display electrode support sheet and the plasma tubes at the position where the second adhesive layer is not in contact with the intermediate layer.

According to the fourth aspect of the present invention, the intermediate layer is formed so as to be in contact with the first adhesive layer, which bonds the address electrode support sheet that is divided by the plurality of plasma tubes and the plasma tubes through the gap between the adjacent address electrode support sheets and the clearance between the adjacent plasma tubes, and the second adhesive layer, which bonds the display electrode support sheet and the plasma tubes, bonds the display electrode support sheet and the plasma tubes at the position where the second adhesive layer is not in contact with the intermediate layer. Therefore, a different type of glue can be used for the first adhesive layer and the second adhesive layer. On the other hand, the type of the glue does not need to be limited, for example, a solvent type acrylic resin can be used for both the first adhesive layer and the second adhesive layer, since the second adhesive layer is not in contact with the intermediate layer. Accordingly, even if a glue with broad utility is used, the intermediate layer can support the plasma tube array as deformed along the surface shape of the address electrode support sheet on the back side. Therefore, cost can be reduced, and further, the generation of the irregularities on the surface shape of the display electrode support sheet on the front side can be prevented.

A fifth aspect of the present invention is directed to a display device comprising the plurality of plasma tube array-type display sub-modules according to any one of the first to fourth aspects of the present invention joined to one another.

According to the fifth aspect of the present invention, when the plurality of plasma tube array-type display sub-modules described above is joined vertically and horizontally to one another to constitute a display panel, the intermediate layer can support the plasma tube array as deformed along the surface shape of the address electrode support sheet on the back side, even if the plasma tube array has any surface shape on the back side. Accordingly, the residual stress is not caused on the plasma tube array, and the generation of the irregularities on the surface shape of the display electrode support sheet on the front side can be prevented. Consequently, the deterioration in an electrical characteristic due to the change in the internal structure can be prevented, whereby a display device that can provide a high-quality image can be provided.

A sixth aspect of the present invention is directed to a display device comprising a plurality of plasma tube each filled with a discharge gas, an address electrode support sheet on the back side having a plurality of address electrodes formed along a longitudinal direction of the plasma tubes, a display electrode support sheet on the front side having a plurality of display electrodes extending in the direction of crossing all the plasma tubes, and the plurality of plasma tubes arranged in parallel and held between the address electrode support sheet and the display electrode support sheet, wherein a hard back support plate is provided through an intermediate layer flexible enough to deform along the surface shape of the address electrode support sheet on the back side.

According to the sixth aspect of the present invention, the hard back support plate is provided through the intermediate layer flexible enough to deform along the surface shape of the address electrode support sheet on the back side. Therefore, the intermediate layer can support the plasma tube array in any surface shape on the back side by deforming along the surface shape of the address electrode support sheet on the back side. Accordingly, the residual stress is not caused on the plasma tube array, and irregularities of the surface shape of the display electrode support sheet on the front side can be prevented from being generated. Since the intermediate layer with flexibility is provided on the back side of the address electrode support sheet, the intermediate layer can absorb a specific abnormal noise generated from the surface of the plasma tube array, whereby the present invention can provide a display device that does not give uncomfortable feeling by the noise to a person seeing an image.

A seventh aspect of the present invention is directed to the display device according to the sixth aspect, wherein the intermediate layer is made of a gel-like material with a Young's modulus of not less than 10 KPa and not more than 200 KPa.

An eighth aspect of the present invention is directed to the display device according to the sixth or seventh aspect of the present invention, wherein the back support plate is made of a hard plastic with a Young's modulus of not less than 1000 KPa and not more than 4000 KPa.

According to the seventh aspect and the eighth aspect of the present invention, the intermediate layer is made of a gel-like material with a Young's modulus of not less than 10 KPa and not more than 200 KPa, and/or the back support plate is made of a hard plastic with a Young's modulus of not less than 1000 KPa and not more than 4000 KPa. Therefore, the intermediate layer can support the plasma tube array in any surface shape on the back side by deforming along the surface shape of the address electrode support sheet on the back side. Accordingly, the residual stress is not caused on the plasma tube array, and the irregularities on the surface shape of the display electrode support sheet on the front side can be prevented from being generated. Since the intermediate layer with flexibility is provided on the back side of the address electrode support sheet, the intermediate layer can absorb the specific abnormal noise generated from the surface of the plasma tube array, whereby the present invention can provide a display device that does not give uncomfortable feeling by the noise to a person seeing an image.

Furthermore, in order to achieve the objects described above, a ninth aspect of the present invention is directed to a display device comprising a plurality of plasma tube each filled with a discharge gas, an address electrode support sheet on the back side having a plurality of address electrodes formed along a longitudinal direction of the plasma tubes, a display electrode support sheet on the front side having a plurality of display electrodes extending in the direction of crossing all the plasma tubes thereon, and the plurality of plasma tubes arranged in parallel and held between the address electrode support sheet and the display electrode support sheet; wherein a hard back support plate with a noise reflecting function is provided through an intermediate layer with a noise absorbing function that can deform along the surface shape of the address electrode support sheet on the back side.

According to the ninth aspect of the present invention, the hard back support plate with a noise reflecting function is provided through the intermediate layer with a noise absorbing function which can deform along the surface shape of the address electrode support sheet on the back side. Therefore, the intermediate layer can support the plasma tube array in any surface shape by deforming along the surface shape of the address electrode support sheet on the back side. The intermediate layer can absorb a specific abnormal noise generated from the surface of the plasma tube array, whereby the present invention can provide a display device that does not give uncomfortable feeling by the noise to a person seeing an image.

A tenth aspect of the present invention is directed to the display device according to the ninth aspect of the present invention, wherein the intermediate layer is made of a gel-like material and the back support plate is made of a hard plastic.

According to the tenth aspect of the present invention, the intermediate layer is made of a gel-like material and the back support plate is made of a hard plastic. Therefore, the intermediate layer can support the plasma tube array in any surface shape on the back side by deforming along the surface shape of the address electrode support sheet on the back side. The intermediate layer can absorb the specific abnormal noise generated from the surface of the plasma tube array, whereby the present invention can provide a display device that does not give uncomfortable feeling by the noise to a person seeing an image.

As described above, the plasma tube array is fixed to the sub-module frame through the intermediate layer that can deform along the surface shape of the address electrode support sheet on the back side. Therefore, the intermediate layer can support the plasma tube array in any surface shape on the back side by deforming along the surface shape of the address electrode support sheet on the back side. Accordingly, the residual stress is not caused on the plasma tube array, and the irregularities on the surface of the display electrode support sheet on the front side can be prevented from being generated.

DESCRIPTION OF THE PREFERRED EMBODIMENTS

A plasma tube array-type display sub-module according to embodiments of the present invention will be described in detail with reference to the drawings.

First Embodiment

Figure 1C:
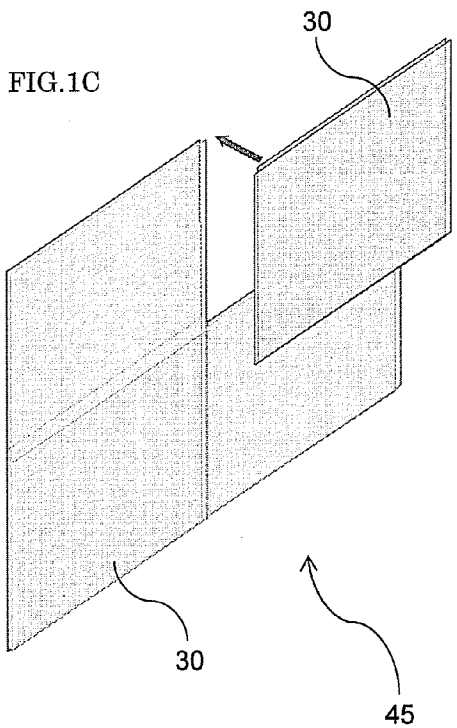
FIGS. 1A to 1C are perspective views each of which shows a schematic configuration of a plasma tube array of a conventional plasma tube array-type display sub-module.
Figure 1A:
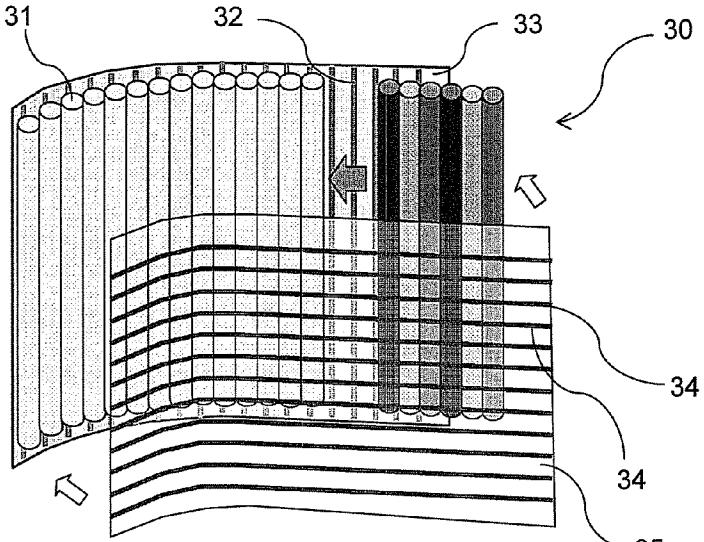
Figure 1B:
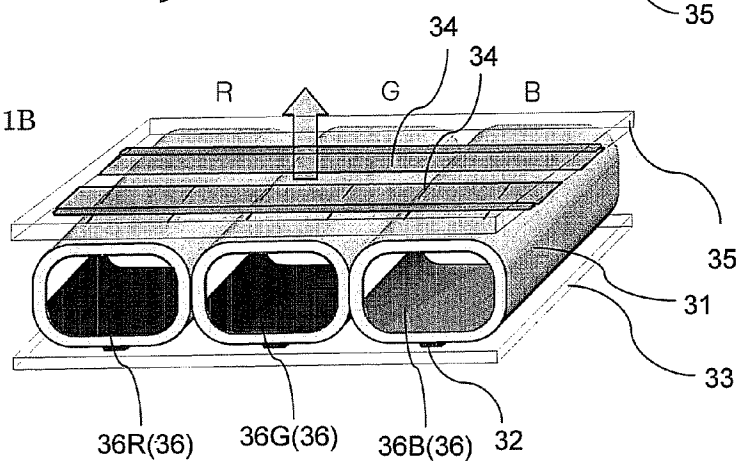
Figure 2A:
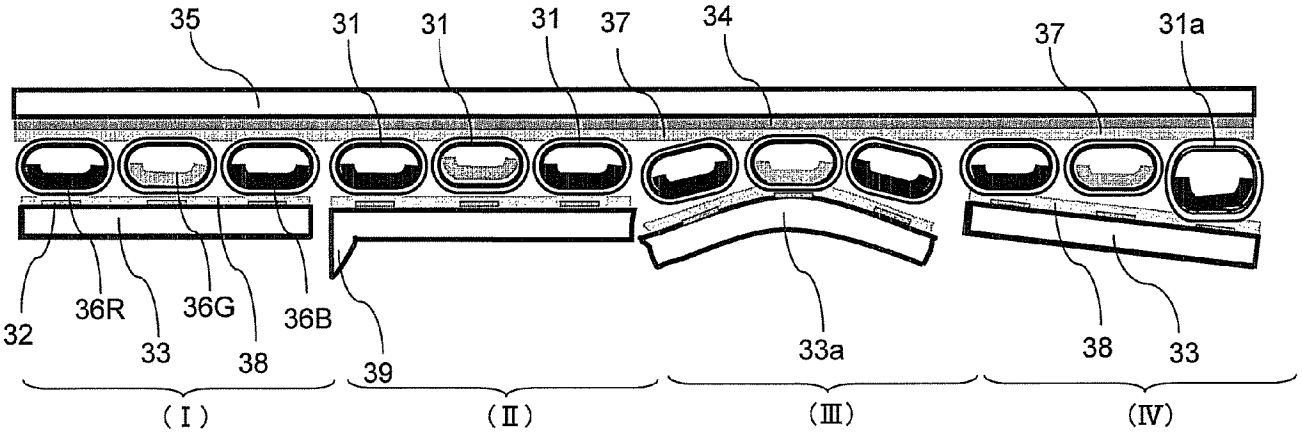
FIGS. 2A and 2B are sectional views, orthogonal to plasma tubes of a plasma tube array.
Figure 2B:
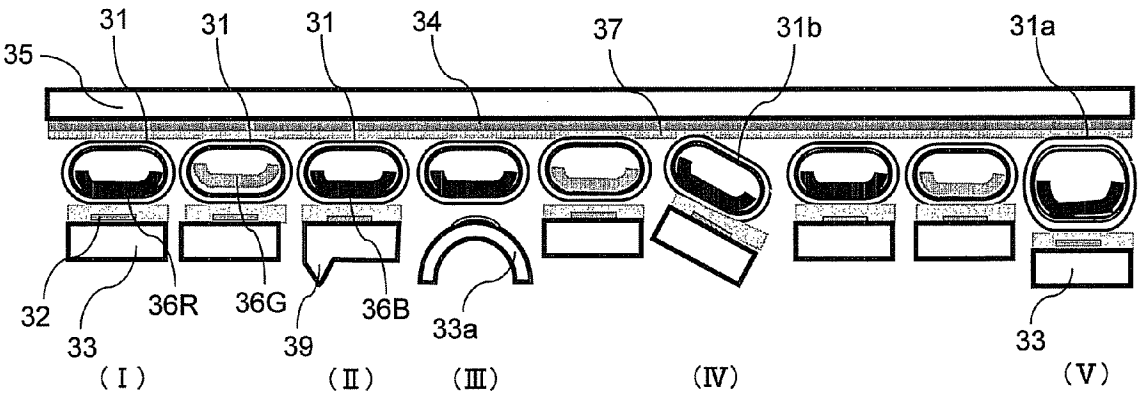

FIGS. 2A and 2B are sectional views orthogonal to plasma tubes 31, 31, . . . of a plasma tube array. More specifically, FIG. 2A is a sectional view showing the case where three plasma tubes 31, 31, 31 for a color display make one set, and an address electrode support sheet 33 is mounted for every/each set. FIG. 2B is a sectional view showing the case where the address electrode support sheet 33 is mounted for each plasma tube 31.

(I) in FIG. 2A and (I) in FIG. 2B show the state of the plasma tube array that is normally fabricated. Specifically, the plasma tubes 31, 31, 31 which make one set, are adhered to the address electrodes 32, 32, . . . of the address electrode support sheet 33 via an adhesive layer (first adhesive layer) 38 such as a glue, and to a display electrode support sheet 35 where display electrodes 34, 34, . . . are formed via an adhesive layer (second adhesive layer) 37 such as a glue. The plasma tubes 31, 31, 31 have respective phosphor layers 36R, 36G, and 36B of red, green, and blue, formed therein.

When the address electrode support sheet 33 is cut, a burr 39 might be generated at the end of the address electrode support sheet 33 as illustrated in (II) in FIG. 2A and (II) in FIG. 2B. A warpage might be caused on the address electrode support sheet 33 depending upon humidity, temperature, or the like. (III) in FIG. 2A and (III) in FIG. 2B show the state of the plasma tube array in the case where the warpage is caused on the address electrode support sheet 33*a*. When the warpage is caused, a gap is likely to be formed between the address electrode support sheet 33*a* and the adhesive layer 38.

Further, irregularities might be formed on the surface shape of the address electrode support sheet 33 on the back side even by the difference in the size, such as the diameter of each plasma tube 31. For example, as shown in (IV) in FIG. 2A and (V) in FIG. 2B, the irregularities are formed on the address electrode support sheet 33 side because a plasma tube 31*a* is larger than the other plasma tubes 31, 31, . . . . When the address electrode support sheet 33 is mounted for every plasma tube 31, the irregularities may be formed on the surface shape of the address electrode support sheet 33 on the back side, because a plasma tube 31*b* is attached aslant as shown in (IV) in FIG. 2B.

Figure 3A:
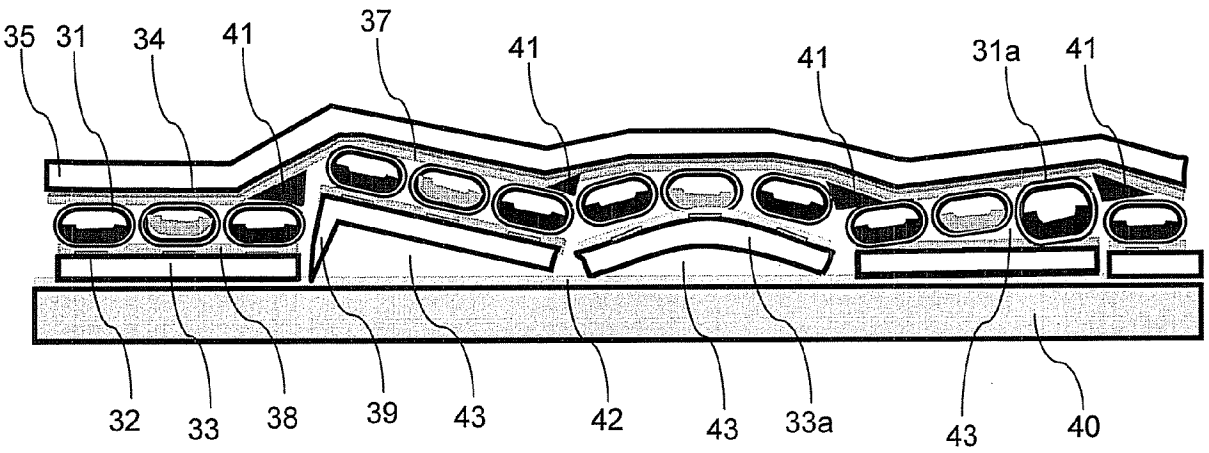
FIGS. 3A and 3B are illustrations each of which shows a configuration of a plasma tube array-type display sub-module using the plasma tube array with irregularities.
Figure 3B:
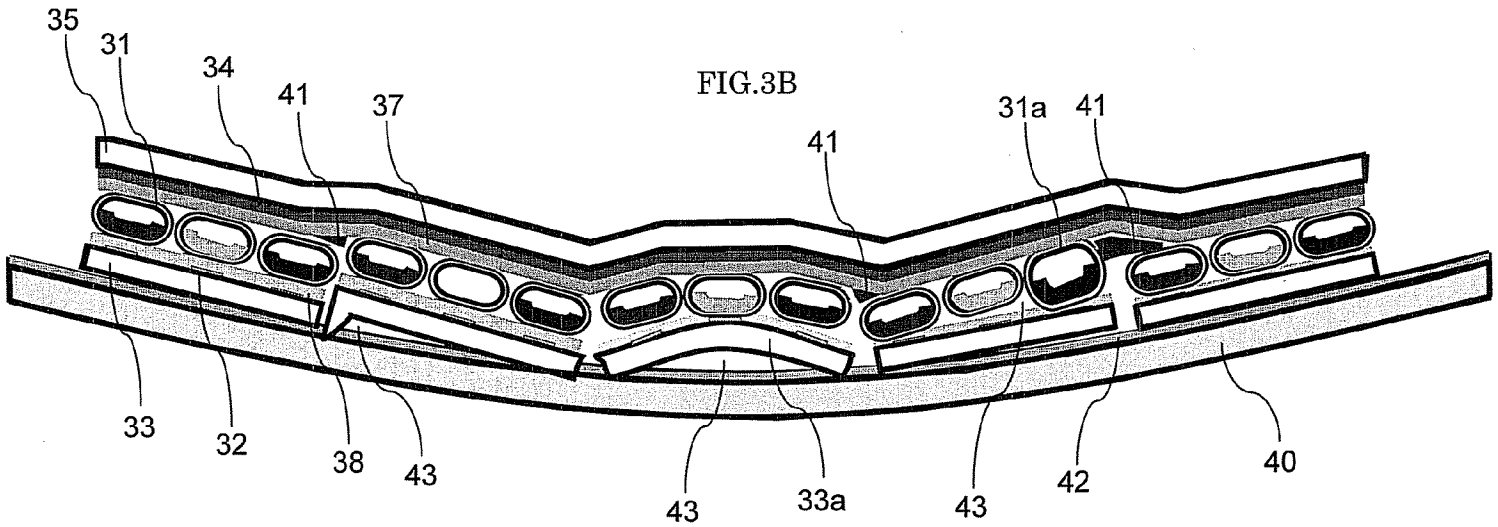

When a plasma tube array-type display sub-module is formed by using the plasma tube array in which the irregularities are formed on the surface shape of the address electrode support sheet 33 on the back side, the irregularities are also formed on the surface shape of the display electrode support sheet 35 on the front side, since a sub-module frame (a back support plate) is made of a hard material. FIGS. 3A and 3B are illustrations each of which shows a configuration of the plasma tube array-type display sub-module using the plasma tube array with the irregularities on the surface shape of the address electrode support sheet 33 on the back side. More specifically, FIG. 3A shows the case where the sub-module frame or plate 40 is flat and FIG. 3B shows the case where the sub-module frame or plate is curved.

As shown in FIG. 3A and FIG. 3B, when the plasma tube array with the irregularities formed on the surface shape of the address electrode support sheet 33 on the back side is bonded to a sub-module frame 40 via an adhesive layer 42 such as a glue, the irregularities are also formed on the surface shape of the display electrode support sheet 35 due to the irregularities formed by the burr 39, the warpage of the address electrode support sheet 33*a*, and the difference in size, i.e., the diameter of the tube, of the plasma tube 31*a*, with the result that a plurality of separation portions 41, 41, . . . is formed between the adhesive layer 37 of the display electrode support sheet 35 and the plasma tubes 31, 31, . . . . Further, a plurality of gaps 43, 43 . . . is formed between the adhesive layer 42, which is provided between the sub-module frame 40 and the address electrode support sheet 33, and the plasma tubes 31, 31, . . . . Moreover, residual stress is caused even at the position where the separation does not occur. This entails deterioration of a discharge protection film in the plasma tube 31, so that electrical characteristic is deteriorated. Accordingly, even when a drive voltage is applied, a desired intensity of an electric field cannot be acquired, which entails a problem that the electrical characteristic is remarkably deteriorated.

Figure 4:
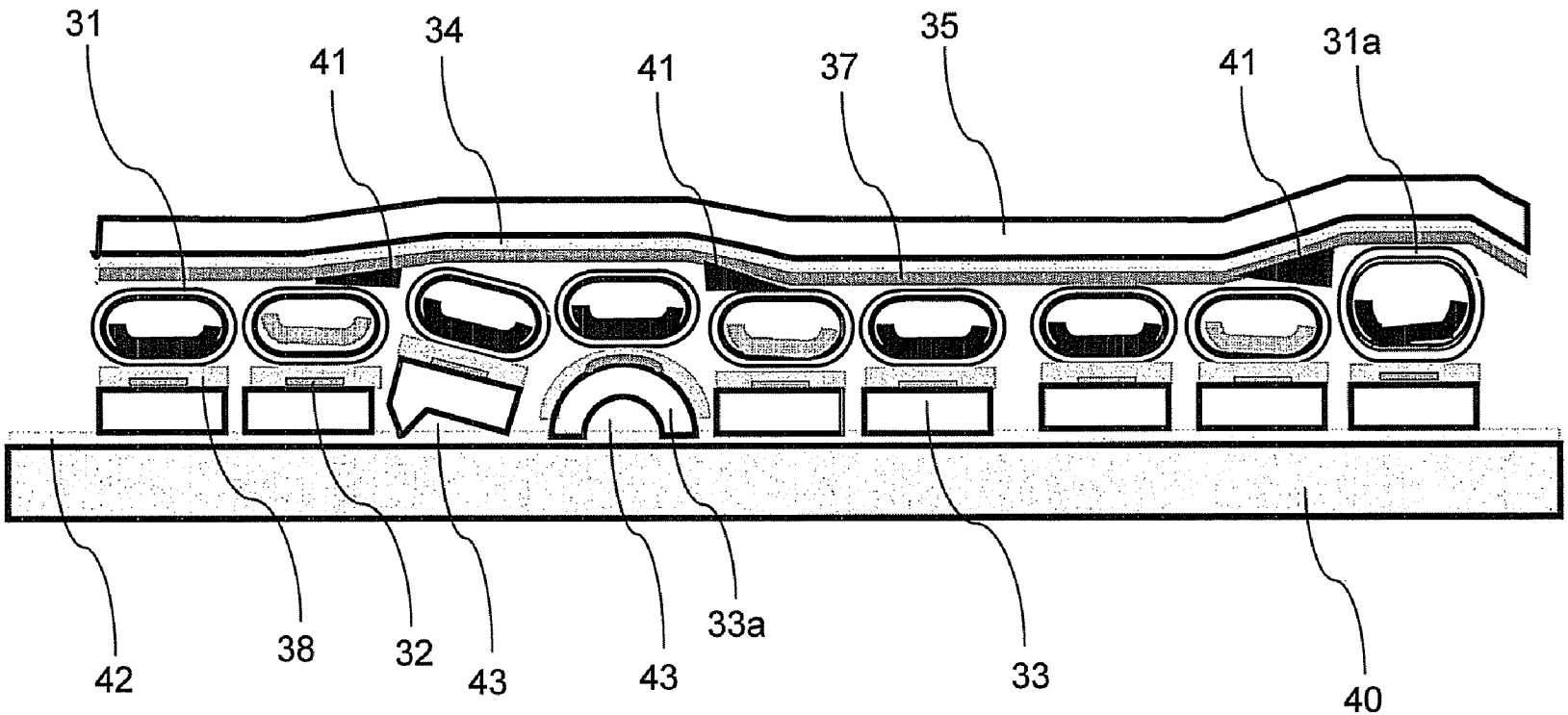
FIG. 4 is an illustration which shows the configuration of the plasma tube array-type display sub-module using the plasma tube array with the irregularities, when an address electrode support sheet is provided for every plasma tube.

FIG. 4 is an illustration which shows the configuration of the plasma tube array-type display sub-module using the plasma tube array with the irregularities formed on the surface shape of the address electrode support sheet 33 on the back side, when the address electrode support sheet 33 is provided for every plasma tube 31. As in FIGS. 3A and 3B, when the plasma tube array with the irregularities formed on the surface shape of the address electrode support sheet 33 on the back side is bonded to the sub-module frame 40 via the adhesive layer 42 such as a glue, the irregularities are also formed on the surface shape of the display electrode support sheet 35 due to the irregularities formed by the burr 39, the warpage of the address electrode support sheet 33*a*, and the difference in size, i.e., the diameter of the tube, of the plasma tube 31*a*, with the result that the plurality of separation portions 41, 41, . . . is formed between the adhesive layer 37 of the display electrode support sheet 35 and the plasma tubes 31, 31, . . . . Further, the plurality of gaps 43, 43, . . . is formed between the adhesive layer 42 and the plasma tubes 31, 31, . . . .

Figure 5:
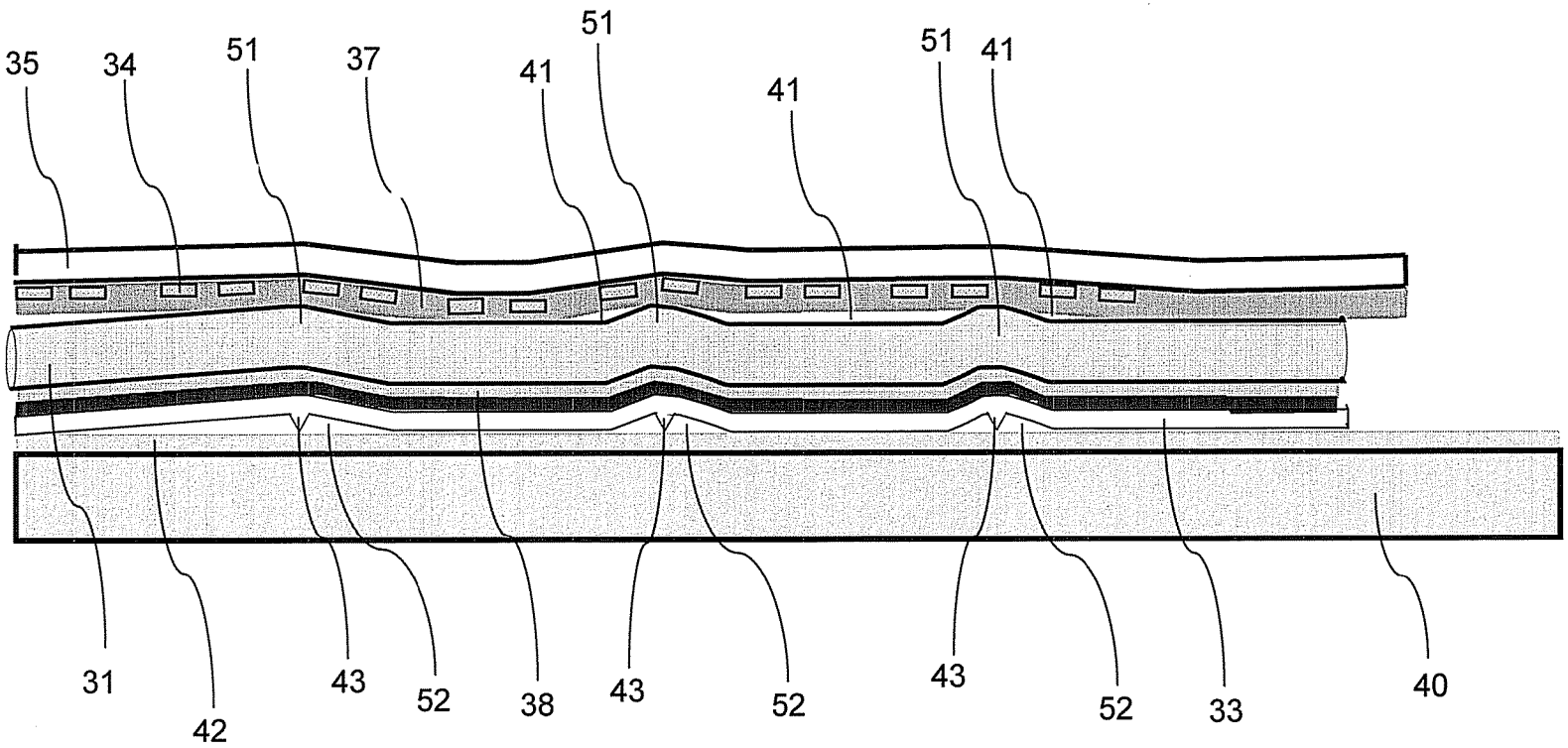
FIG. 5 is an illustrative sectional view along the plasma tubes on the side including the address electrode support sheet, which shows the plasma tube array-type display sub-module using the plasma tube array with the irregularities.

FIG. 5 is an illustrative sectional view along the plasma tubes 31, 31, . . . on the side including the address electrode support sheet 32, which shows the plasma tube array-type display sub-module using the plasma tube array with the irregularities on the surface shape of the address electrode support sheet 33 on the back side. Although the direction is different, as in FIG. 3A, FIG. 3B and FIG. 4, when the plasma tube array with the irregularities formed on the surface shape of the address electrode support sheet 33 on the back side is bonded to the sub-module frame 40 via the adhesive layer 42 such as a glue, the irregularities might also be formed on the surface shape of the display electrode support sheet 35, and further, a deformed portion 51 where the plasma tube 31 itself deforms due to the irregularities formed by the burr 39, the warpage of the address electrode support sheet 33, and the difference in size, i.e., the diameter of the tube, of the plasma tube 31. By the deformation of the plasma tube 31, a plurality of gaps 52, 52, . . . is formed between the address electrode support sheet 33 and the sub-module frame 40, and the gaps 52, 52, . . . thereof may cause noise generated from the plasma tubes 31, 31, . . . .

Figure 6A:
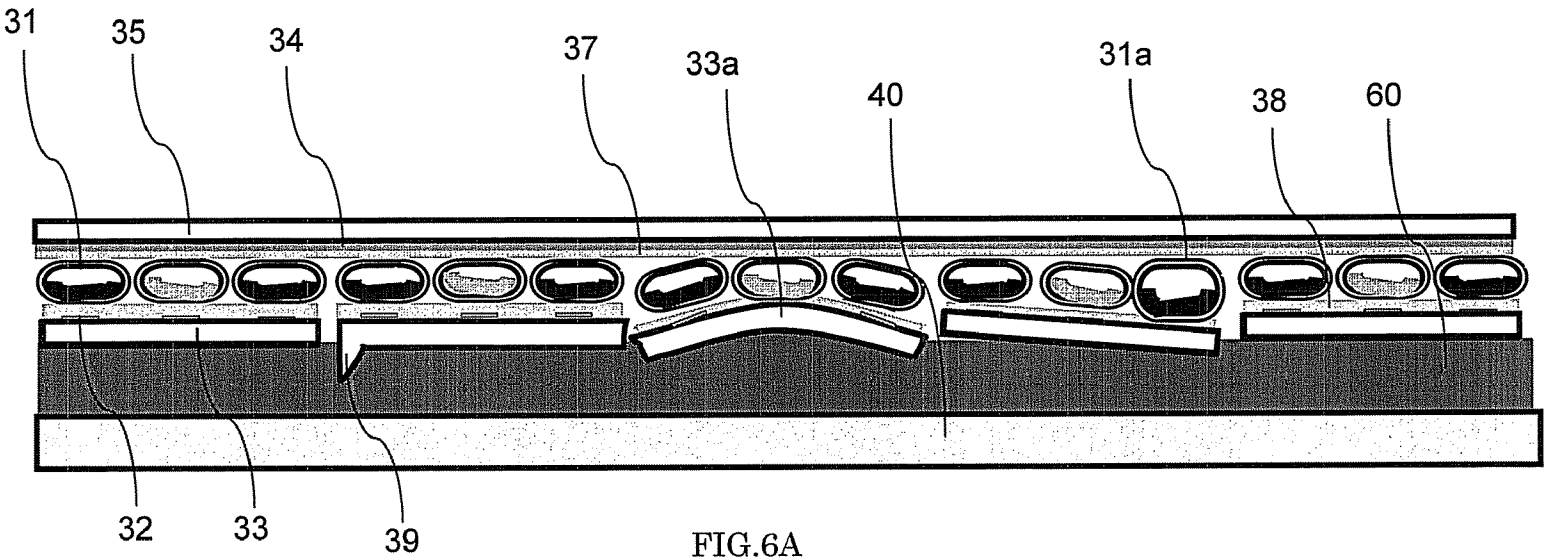
FIGS. 6A and 6B are sectional views, orthogonal to the plasma tubes, each of which shows the schematic configuration of the plasma tube array-type display sub-module according to a first embodiment of the present invention.
Figure 6B:
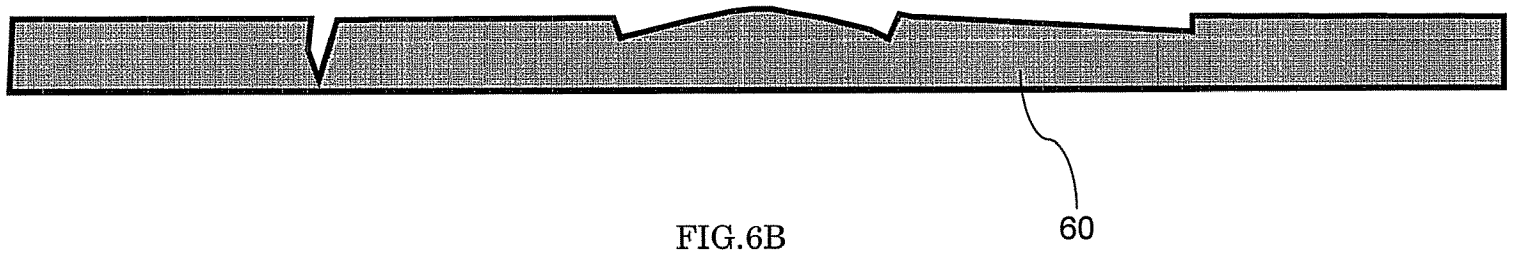

In view of this, the first embodiment is featured in that an intermediate layer made of a hardening resin, e.g., a thermosetting resin, is formed between the sub-module frame 40 and the plasma tube array, and the irregularities formed on the surface shape of the address electrode support sheet 33 on the back side are absorbed during the process of forming the intermediate layer. FIGS. 6A and 6B are sectional views, orthogonal to the plasma tubes 31, 31, . . . , each of which shows the schematic configuration of the plasma tube array-type display sub-module according to the first embodiment of the present invention. More specifically, FIG. 6A shows an overall configuration of the plasma tube array-type display sub-module including an intermediate layer 60 according to the first embodiment. FIG. 6B shows the configuration of the intermediate layer 60.

As shown in FIG. 6A, the plasma tube array is provided so as to be embedded into the intermediate layer 60 which is made of the thermosetting resin and formed on the surface of the sub-module frame 40. In the state that the plasma tube array is embedded to a predetermined depth in the intermediate layer 60, heat is applied to cure the intermediate layer 60, whereby the intermediate layer 60 is formed. As the intermediate layer 60 is formed so as to have the sectional shape as shown in FIG. 6A, the intermediate layer 60 with the shape along the formed irregularities can be formed even if any irregularities are formed on the surface shape of the address electrode support sheet 33 on the back side. Accordingly, the irregularities, due to the irregularities on the address electrode support sheet 33 on the back side are not formed on the surface shape of the display electrode support sheet 35. Therefore, the separation portion 41 is not formed between the adhesive layer 37 of the display electrode support sheet 35 and the plasma tubes 31, 31, . . . . Further, the thermosetting resin is filled in the gap 43 in FIG. 4 (the gap 52 in FIG. 5). It is necessary that the thermosetting resin used for the intermediate layer 60 is more flexible than the plasma tube array before heated to have a shape along any irregularities formed on the surface shape of the address electrode support sheet 33 on the back side. Moreover, it is necessary that the thermosetting resin is more flexible than the plasma tube array even after thermally cured, so that unnecessary force is not applied to the plasma tube array.

Figure 7A:
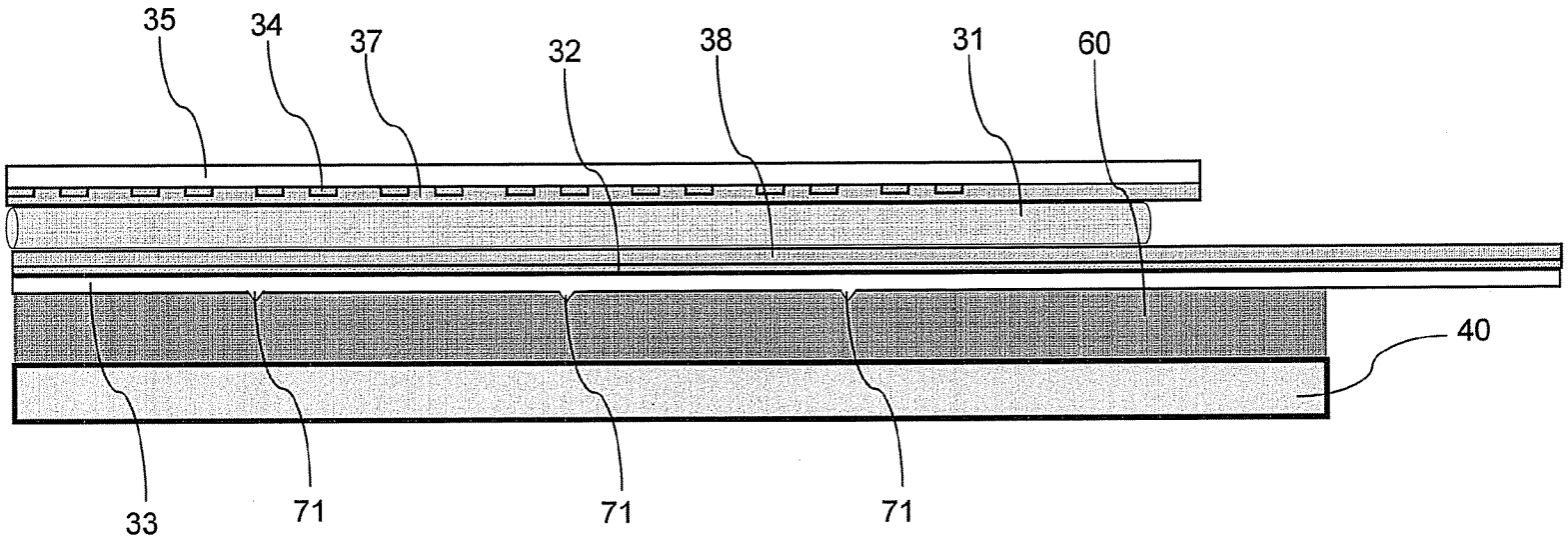
FIGS. 7A and 7B are illustrative sectional views along the plasma tubes on the side including the address electrode each of which shows the plasma tube array-type display sub-module according to the first embodiment of the present invention.
Figure 7B:
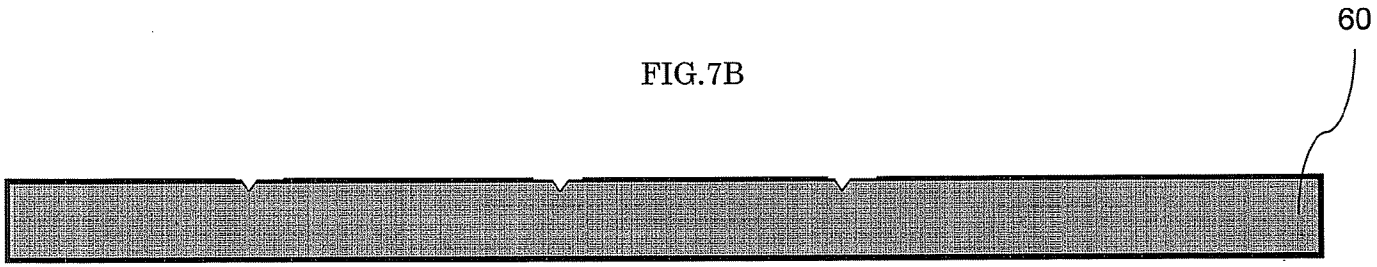

FIGS. 7A and 7B are illustrative sectional views along the plasma tubes 31, 31, . . . on the side including the address electrode 32 each of which shows the plasma tube array-type display sub-module according to the first embodiment of the present invention. More specifically, FIG. 7A shows an overall configuration of the plasma tube array-type display sub-module including the intermediate layer 60 according to the first embodiment of the present invention. FIG. 7B shows the configuration of the intermediate layer 60.

As shown in FIG. 7A, the plasma tube array is provided so as to be embedded into the intermediate layer 60 which is made of the thermosetting resin and formed on the surface of the sub-module frame 40. In the state that the plasma tube array is embedded to a predetermined depth in the intermediate layer 60, heat is applied to cure the intermediate layer 60, whereby the intermediate layer 60 is formed. Since the intermediate layer 60 is formed so as to have the sectional shape as shown in FIG. 7B, the plurality of irregularities 71, 71, . . . is absorbed by the intermediate layer 60 with the shape along the irregularities 71, 71, even if a plurality of irregularities 71, 71, . . . is formed on the plasma tube array on the back side of the intermediate layer 60. Therefore, the surface shape of the display electrode support sheet 35 does not deform along the irregularities 71, 71, . . . , whereby the plasma tube 31 is not deformed.

The thickness of the intermediate layer 60 varies depending upon the type of the glue for the adhesive layer 37 that bonds the display electrode support sheet 35 and the plasma tube array, the type of the glue for the adhesive layer 38 that bonds the address electrode support sheet 33 and the plasma tube array, and the material of the intermediate layer 60. In the first embodiment, the thermosetting resin such as a solvent type acrylic resin, for example, is used for the intermediate layer 60. It is preferable to use the solvent type acrylic resin for both the adhesive layers 37 and 38 in order to minimize the type of the synthetic resin to use.

However, the solvent type acrylic resin might cause a trouble such as a separation by a dissolution or a chemical reaction when the adhesive layers 37, 38 are in contact with each other. In view of this, the height of the address electrode support sheet 33, which is the most proximate to the sub-module frame 40, of the address electrode support sheets 33, 33, . . . is defined as a limit, and the thermosetting resin is filled to this limit so as to form the intermediate layer 60.

Figure 8A:
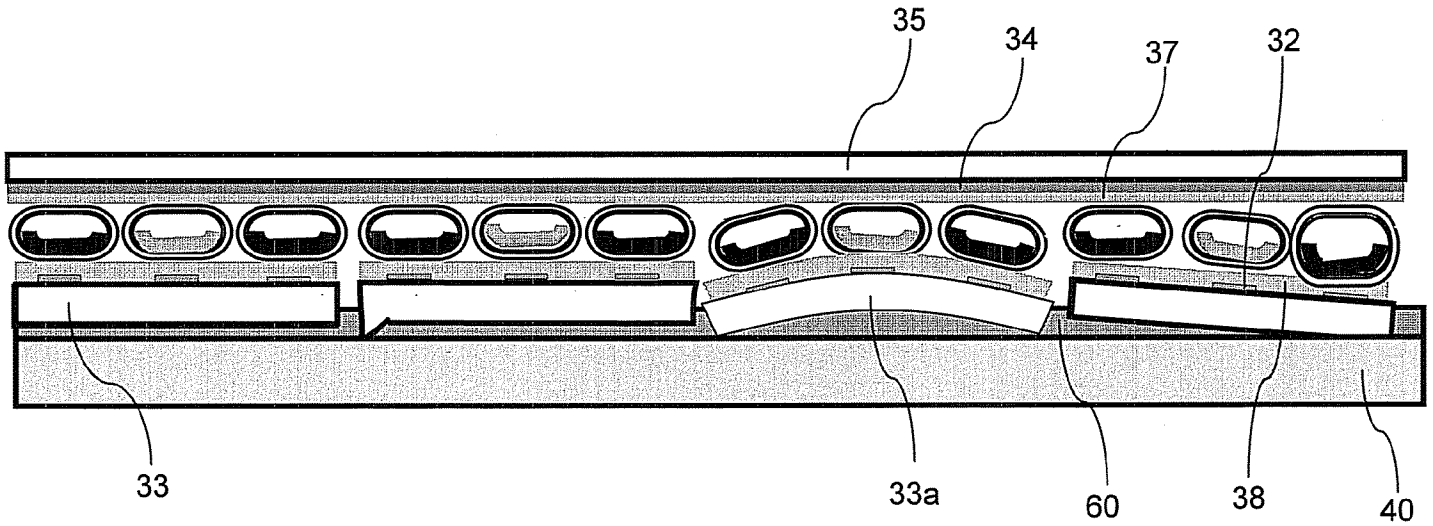
FIGS. 8A and 8B are sectional views, orthogonal to the plasma tubes, each of which shows the schematic configuration of the plasma tube array-type display sub-module according to the first embodiment of the present invention.
Figure 8B:
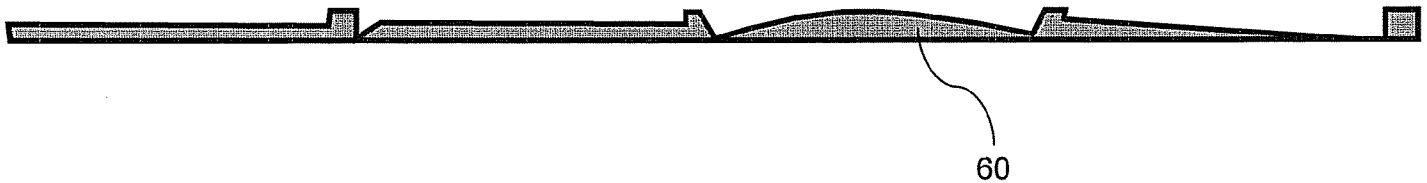

FIGS. 8A and 8B are sectional views, orthogonal to the plasma tubes 31, 31, . . . each of which shows a schematic configuration of the plasma tube array-type display sub-module according to the first embodiment of the present invention. More specifically, FIG. 8A shows the overall configuration of the plasma tube array-type display sub-module including the intermediate layer 60 according to the first embodiment. FIG. 8B shows the configuration of the intermediate layer 60.

As shown in FIG. 8A, the plasma tube array is provided so as to be embedded into the intermediate layer 60 which is made of the thermosetting resin and formed on the surface of the sub-module frame 40. The intermediate layer 60 is formed in such a manner that the height of the address electrode support sheet 33, which is the most proximate to the sub-module frame 40, of the address electrode support sheets 33, 33, . . . is defined as a limit. As the thin intermediate layer 60 is formed so as to have the sectional shape as shown in FIG. 8B, the intermediate layer 60 with the shape along the formed irregularities can be formed, even if any irregularities are formed on the surface shape of the address electrode support sheet 33 on the back side. Accordingly, the irregularities due to the irregularities on the surface shape of the address electrode support sheet 33 on the back side, are not formed on the surface shape of the display electrode support sheet 35. Therefore, the separation portion 41 is not formed between the adhesive layer 37 of the display electrode support sheet 35 and the plasma tubes 31, 31, . . . . Further, the thermosetting resin is filled in the gap 43 in FIG. 4 (the gap 52 in FIG. 5).

One type of the synthetic resin is enough and the intermediate layer 60 can be formed with only a minimum amount of the synthetic resin. Therefore, the effective intermediate layer 60 can be formed at low cost. Since the thickness of the intermediate layer 60 is reduced, the intermediate layer 60 and the adhesive layer 38 are not easily brought into contact with each other, even when pressure is applied from the front side of the plasma tube array (the display electrode support sheet 35 side) before the intermediate layer 60 is cured, whereby the intermediate layer 60 can be formed more safely.

According to the first embodiment of the present invention, as described above, the intermediate layer 60 with the shape along the formed irregularities can be formed easily, even if any irregularities are formed on the surface shape of the address electrode support sheet 33 on the back side. Therefore, the irregularities due to the irregularities on the surface shape of the address electrode support sheet 33 on the back side, are not formed on the surface shape of the display electrode support sheet 35. Further, the separation portion 41 between the adhesive layer 37 and the plasma tubes 31, 31, . . . as well as the gap 43 (the gap 52) between the adhesive layer 42 and the plasma tubes 31, 31, . . . are not formed. Accordingly, the deterioration in the electrical characteristic in the plasma tube 31 is prevented, and further, a designed voltage is enough for the drive voltage to apply. Consequently, a display device of a large screen with a high image quality can be realized.

Second Embodiment

The second embodiment is different from the first embodiment in that a thermosetting resin, such as a solventless type epoxy resin, for example, is used for the intermediate layer 60, and that a thermosetting resin such as a solvent type acrylic resin, for example, is used for the adhesive layers 37 and 38. The solventless type epoxy resin and the solvent type acrylic resin are not dissolved, and a chemical reaction does not occur between them even when they are brought into contact with each other. Therefore, the intermediate layer 60 can be formed in the region where the intermediate layer 60 can support the plasma tubes 31, 31, . . . . A solventless type acrylic resin may be used for the intermediate layer 60.

Figure 9A:
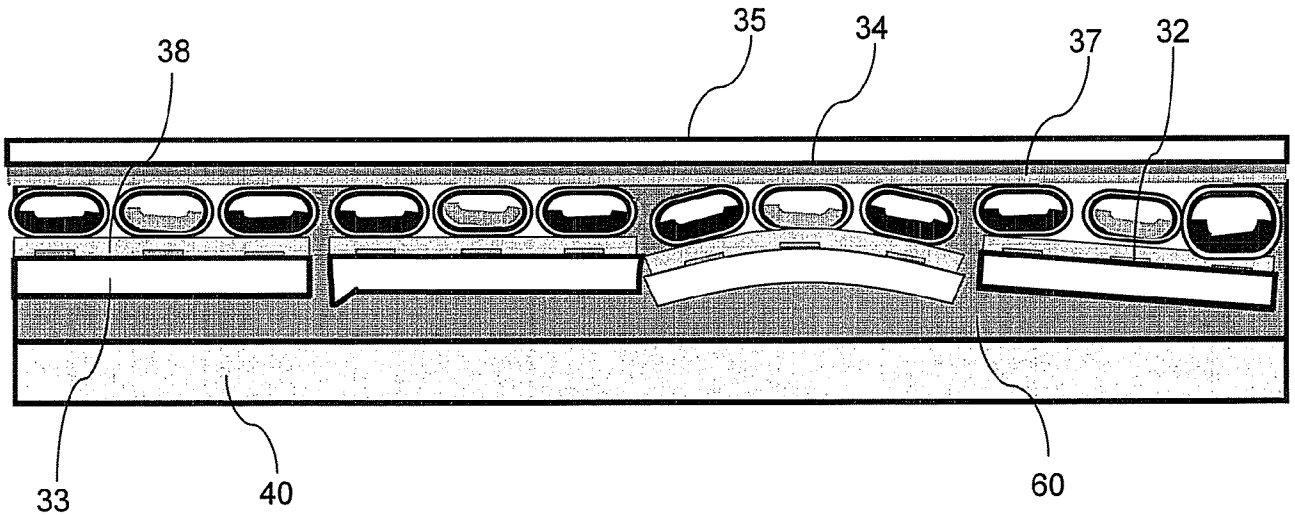
FIGS. 9A and 9B are sectional views, orthogonal to the plasma tubes, each of which shows the schematic configuration of the plasma tube array-type display sub-module according to a second embodiment of the present invention.
Figure 9B:
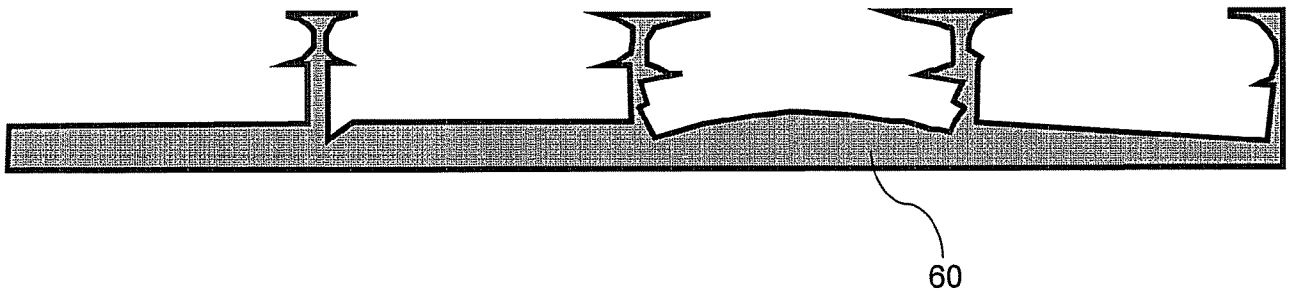

FIGS. 9A and 9B are sectional views, orthogonal to the plasma tubes 31, 31, . . . each of which shows a schematic configuration of the plasma tube array-type display sub-module according to the second embodiment of the present invention. More specifically, FIG. 9A shows the overall configuration of the plasma tube array-type display sub-module including the intermediate layer 60 according to the second embodiment. FIG. 9B shows the configuration of the intermediate layer 60.

As shown in FIG. 9A, the plasma tube array is provided so as to be embedded into the intermediate layer 60 which is made of the thermosetting resin and formed on the surface of the sub-module frame 40. The intermediate layer 60 is formed in such a manner that the thermosetting resin is filled in the display electrode support sheet 35 through the gap between the address electrode support sheets 33, 33, . . . . Since the thick intermediate layer 60 is formed so as to have the sectional shape as shown in FIG. 9B, the intermediate layer 60 with the shape along the formed irregularities can be formed, even if any irregularities are formed on the surface shape of the address electrode support sheet 33 on the back side. Accordingly, the irregularities due to the irregularities on the address electrode support sheet 33 on the back side, are not formed on the surface shape of the display electrode support sheet 35. Therefore, the separation portion 41 is not formed between the adhesive layer 37 of the display electrode support sheet 35 and the plasma tubes 31, 31, . . . . Further, the thermosetting resin is filled in the gap 43 in FIG. 4 (the gap 52 in FIG. 5).

The intermediate layer 60 can support respective set of the plasma tubes 31, 31, 31, so that the plasma tubes 31, 31, . . . hardly vibrate. Accordingly, this structure can effectively prevent the generation of noise from the plasma tubes 31, 31, . . . .

Figure 10A:
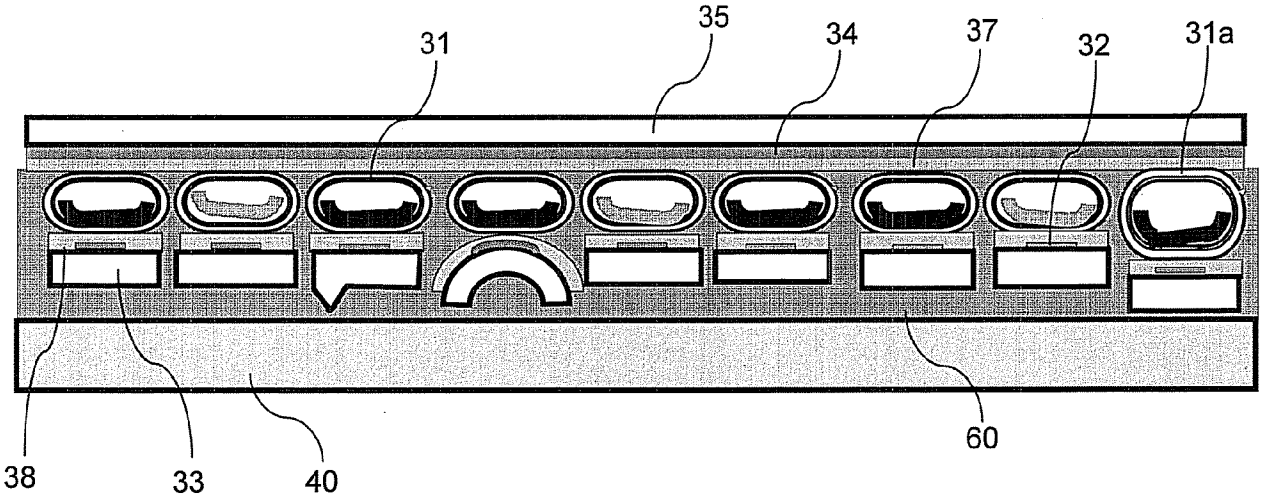
FIGS. 10A and 10B are sectional views, orthogonal to the plasma tubes, each of which shows the schematic configuration of the plasma tube array-type display sub-module according to the second embodiment of the present invention, when the address electrode support sheet is provided for every plasma tube.
Figure 10B:
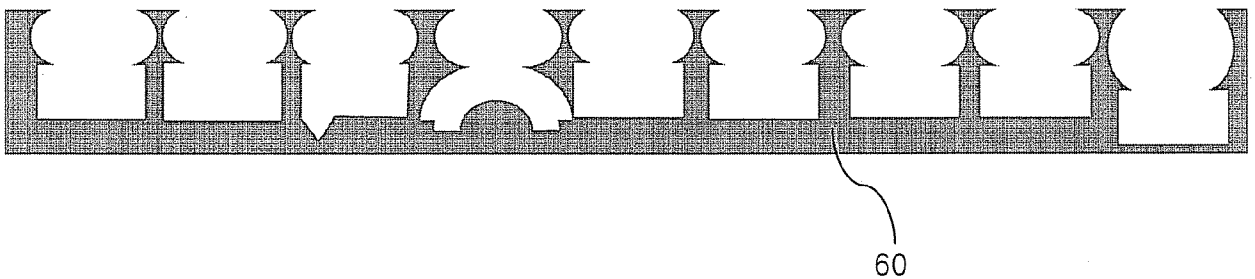

FIGS. 10A and 10B are sectional views, orthogonal to the plasma tubes 31, 31, . . . , each of which shows the schematic configuration of the plasma tube array-type display sub-module according to the second embodiment of the present invention, when the address electrode support sheet 33 is provided for every plasma tube 31. More specifically, FIG. 10A shows the overall configuration of the plasma tube array-type display sub-module including the intermediate layer 60 according to the second embodiment. FIG. 10B shows the configuration of the intermediate layer 60.

As shown in FIG. 10A, the plasma tube array is provided so as to be embedded into the intermediate layer 60 which is made of the thermosetting resin and formed on the surface of the sub-module frame 40. The intermediate layer 60 is formed so as to reach the display electrode support sheet 35 in such a manner that the thermosetting resin is filled in the surrounding of each plasma tubes 31 through the gap between the address electrode support sheets 33, 33, . . . . Since the thick intermediate layer 60 is formed so as to have the sectional shape as shown in FIG. 10B, the intermediate layer 60 with the shape along the formed irregularities can be formed even if any irregularities are formed on the surface shape of the address electrode support sheet 33 on the back side. Accordingly, the irregularities due to the irregularities on the address electrode support sheet 33 on the back side, are not formed on the surface shape of the display electrode support sheet 35. Therefore, the separation portion 41 is not formed between the adhesive layer 37 of the display electrode support sheet 35 and the plasma tubes 31, 31, . . . . Further, the thermosetting resin is filled in the gap 43 in FIG. 4 (the gap 52 in FIG. 5).

The intermediate layer 60 can support each of the plasma tubes 31, 31, . . . , so that the plasma tubes 31, 31, . . . hardly vibrate. Accordingly, this structure can effectively prevent the generation of noise from the plasma tubes 31.

According to the second embodiment, as described above, even if the adhesive layers 37, 38 and the intermediate layer 60 are brought into contact with each other, a chemical reaction does not occur between them, whereby the plasma tube array can be adhered onto the sub-module frame 40 without deteriorating the quality of the plasma tube array. Since the intermediate layer 60 can support each of the plasma tubes 31, 31, . . . so as to fix it at a predetermined position, the generation of a specific noise due to the vibration of the plasma tube 31 can effectively be prevented.

Third Embodiment

The third embodiment, as in the second embodiment, is different from the first embodiment in that a thermosetting resin, such as a solventless type epoxy resin, for example, is used for the intermediate layer 60, and that a solvent type acrylic resin, for example, is used for the adhesive layers 37 and 38. The solventless type epoxy resin and the solvent type acrylic resin are not dissolved, and a chemical reaction does not occur between them even when they are brought into contact with each other. Therefore, the intermediate layer 60 can be formed in the region where the intermediate layer 60 can support the plasma tubes 31, 31, . . . . A solventless type acrylic resin may be used for the intermediate layer 60.

The epoxy resin may be used for the intermediate layer 60, while a rubber resin such as a silicon may be used for the adhesive layer 38. Further, the rubber resin such as the silicon may be used for the adhesive layer 37, and the solvent type acrylic resin may be used for the adhesive layer 37. In this case, the epoxy resin and the rubber resin are not dissolved, and a chemical reaction does not occur between them even when they are brought into contact with each other. Therefore, the intermediate layer 60 can be formed to have a height enough to support the plasma tubes 31, 31, . . . .

On the other hand, when the solvent type acrylic resin is brought into contact with the rubber resin such as the silicon, both are dissolved, or a chemical reaction occurs between them, resulting in entailing a trouble such as a separation. In view of this, the height where the intermediate layer 60 is not in contact with the adhesive layer 37 is defined as a limit, and the thermosetting resin is filled to this limit so as to form the intermediate layer 60.

Figure 11A:
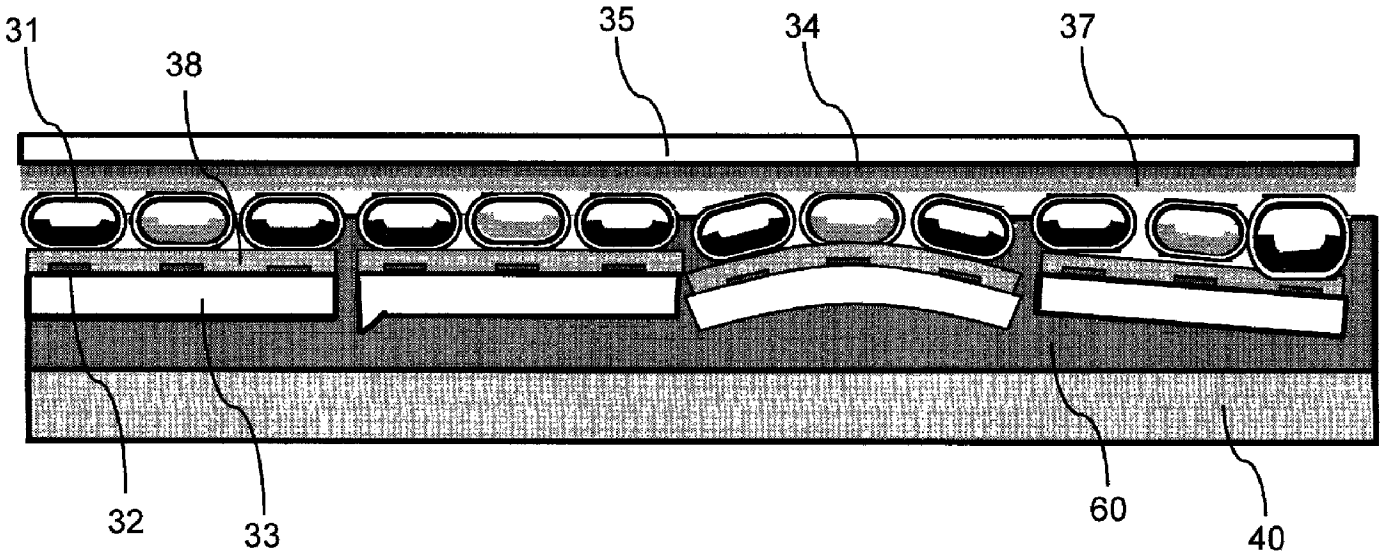
FIGS. 11A and 11B are sectional views, orthogonal to the plasma tubes, each of which shows the schematic configuration of the plasma tube array-type display sub-module according to a third embodiment of the present invention.
Figure 11B:
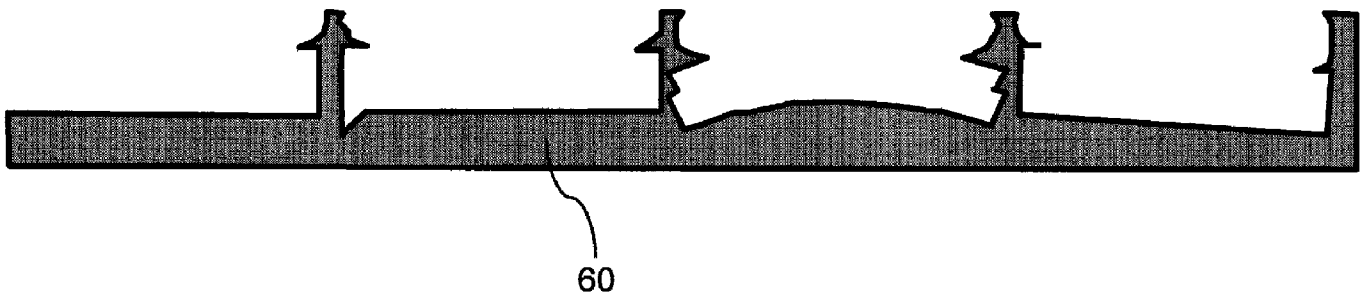

FIGS. 11A and 11B are sectional views, orthogonal to the plasma tubes 31, 31, . . . , each of which shows the schematic configuration of the plasma tube array-type display sub-module according to the third embodiment of the present invention, when the address electrode support sheet 33 is provided for every set of the plasma tubes 31, 31, 31. More specifically, FIG. 11A shows the overall configuration of the plasma tube array-type display sub-module including the intermediate layer 60 according to the third embodiment. FIG. 11B shows the configuration of the intermediate layer 60.

As shown in FIG. 11A, the plasma tube array is provided so as to be embedded into the intermediate layer 60 which is made of the thermosetting resin and formed on the surface of the sub-module frame 40. The intermediate layer 60 is formed in such a manner that the thermosetting resin is filled in the lower-half surrounding of each the plasma tube 31 through the gap between the address electrode support sheets 33, 33, . . . . Since the thick intermediate layer 60 is formed so as to have the sectional shape as shown in FIG. 11B, the intermediate layer 60 with the shape along the formed irregularities can be formed, even if any irregularities are formed on the surface shape of the address electrode support sheet 33 on the back side. Accordingly, the irregularities due to the irregularities on the address electrode support sheet 33 on the back side, are not formed on the surface shape of the display electrode support sheet 35. Therefore, the separation portion 41 is not formed between the adhesive layer 37 of the display electrode support sheet 35 and the plasma tubes 31, 31, . . . . Further, the thermosetting resin is filled in the gap 43 in FIG. 4 (the gap 52 in FIG. 5).

The intermediate layer 60 can support respective set of the plasma tubes 31, 31, 31, so that the plasma tubes 31, 31, . . . hardly vibrate. Accordingly, this structure can effectively prevent the generation of noise from the plasma tubes 31, 31, . . . .

Figure 12A:
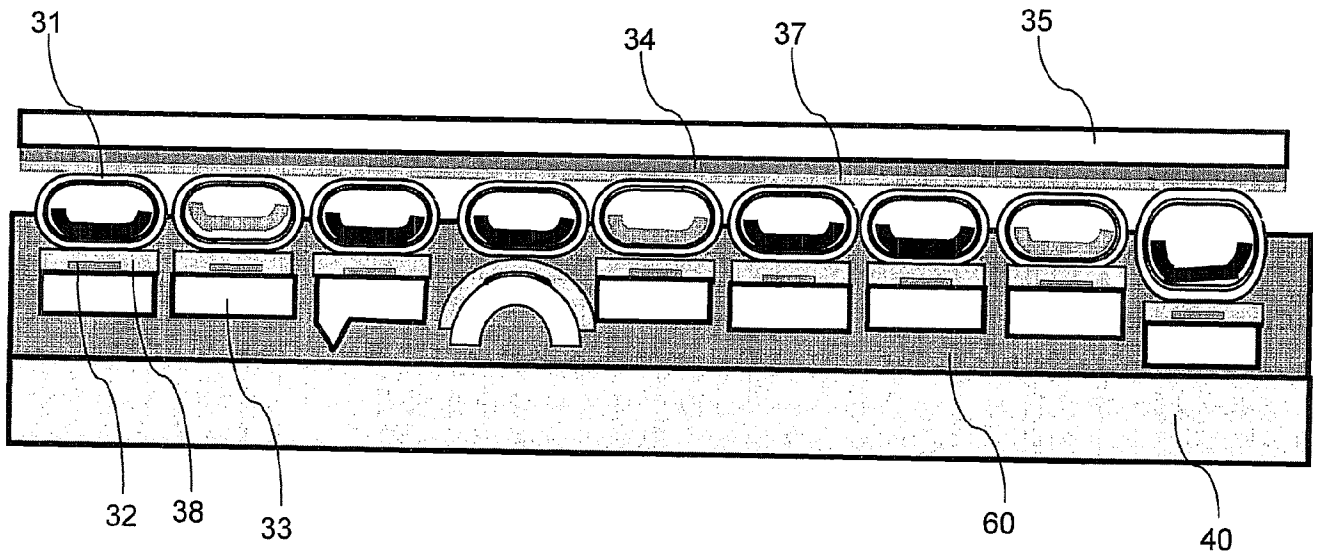
FIGS. 12A and 12B are sectional views, orthogonal to the plasma tubes, each of which shows the schematic configuration of the plasma tube array-type display sub-module according to the third embodiment of the present invention, when the address electrode support sheet is provided for every plasma tube.
Figure 12B:
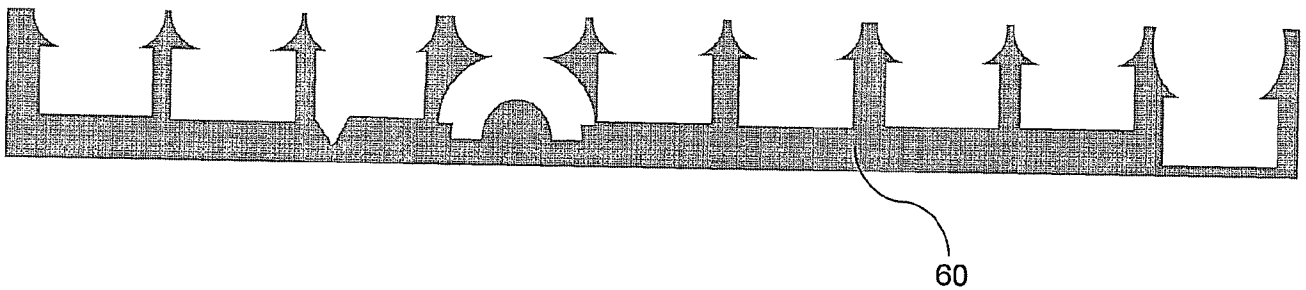

FIGS. 12A and 12B are sectional views, orthogonal to the plasma tubes 31, 31, . . . each of which shows the schematic configuration of the plasma tube array-type display sub-module according to the third embodiment of the present invention, when the address electrode support sheet 33 is provided for every plasma tube 31. More specifically, FIG. 12A shows the overall configuration of the plasma tube array-type display sub-module including the intermediate layer 60 according to the third embodiment. FIG. 12B shows the configuration of the intermediate layer 60.

As shown in FIG. 12A, the plasma tube array is provided so as to be embedded into the intermediate layer 60 which is made of the thermosetting resin and formed on the surface of the sub-module frame 40. The intermediate layer 60 is formed in such a manner that the thermosetting resin is filled in the lower-half surrounding of each plasma tube 31 through the gap between the address electrode support sheets 33, 33, . . . . Since the thick intermediate layer 60 is formed so as to have the sectional shape as shown in FIG. 12B, the intermediate layer 60 with the shape along the formed irregularities can be formed, even if any irregularities are formed on the surface shape of the address electrode support sheet 33 on the back side. Accordingly, the irregularities due to the irregularities on the address electrode support sheet 33 on the back side are not formed on the display electrode support sheet 35. Therefore, the separation portion 41 is not formed between the adhesive layer 37 of the display electrode support sheet 35 and the plasma tubes 31, 31, . . . . Further, the thermosetting resin is filled in the gap 43 in FIG. 4 (the gap 52 in FIG. 5).

The intermediate layer 60 can support each of the plasma tubes 31, 31, . . . , so that the plasma tubes 31, 31, . . . hardly vibrate. Accordingly, this structure can effectively prevent the generation of noise from the plasma tubes 31, 31, . . . . Further, the material of the adhesive layer 37 does not matter. Therefore, cost can be reduced by using a less-expensive synthetic resin.

As described above, according to the third embodiment, even if the adhesive layer 38 and the intermediate layer 60 are brought into contact with each other, a chemical reaction does not occur between them, whereby the plasma tube array can be adhered onto the sub-module frame 40 without deteriorating the quality of the plasma tube array. Since the intermediate layer 60 can support each of the plasma tubes 31, 31, . . . so as to fix it at a predetermined position, the generation of specific noise due to the vibration of the plasma tubes 31, 31, . . . can effectively be prevented.

In the first to third embodiments described above, it is supposed that a separate structure body is used as the sub-module frame. However, the sub-module frame may be made of a material same as that of the intermediate layer 60. In this case, the intermediate layer 60 can be made of an epoxy resin or an acrylic resin.

Fourth Embodiment

The configuration of the plasma tube array-type display sub-module according to the fourth embodiment of the present invention is the same as that in the first embodiment. Therefore, the same numerals are given and the detailed description will not be repeated. The fourth embodiment is different from the first embodiment in that a gel-like material with a noise absorbing function is used for the intermediate layer 60 to absorb an abnormal noise generated from the plasma tube array.

Specifically, when two plasma tube array-type display sub-modules are joined to each other, each of the address electrode support sheets 33, 33, . . . having the address electrodes 32, 32, . . . formed thereon is bent toward the back side in order not to form a gap between the plasma tube arrays as less as possible. The same is true for the display electrode support sheet 35 having the display electrodes 34, 34, . . . formed thereon.

Accordingly, the plasma tubes 31, 31, . . . are arranged extremely proximate to each other. When a drive voltage is applied, the shape of each plasma tube 31 is slightly deformed due to the pressure variation or temperature change inside the plasma tubes 31, 31, . . . . The production precision itself varies of the plasma tubes 31, 31, . . . , wherein the size, i.e., the diameter, of each of the plasma tubes 31, 31, . . . is non-constant. These factors are correlated with each other, resulting in that, depending upon a drive input pattern, resonance occurs with a vibration mode specific to the plasma tube array, and therefore, the abnormal noise is generated from the surface of the plasma tube array.

The abnormal noise generated from the surface of the plasma tube array is transmitted through the display electrode support sheet 35, and emit to a person who sees an image of the display device from the front side. The abnormal noise might cause uncomfortable feeling to person seeing the image.

Figure 13A:
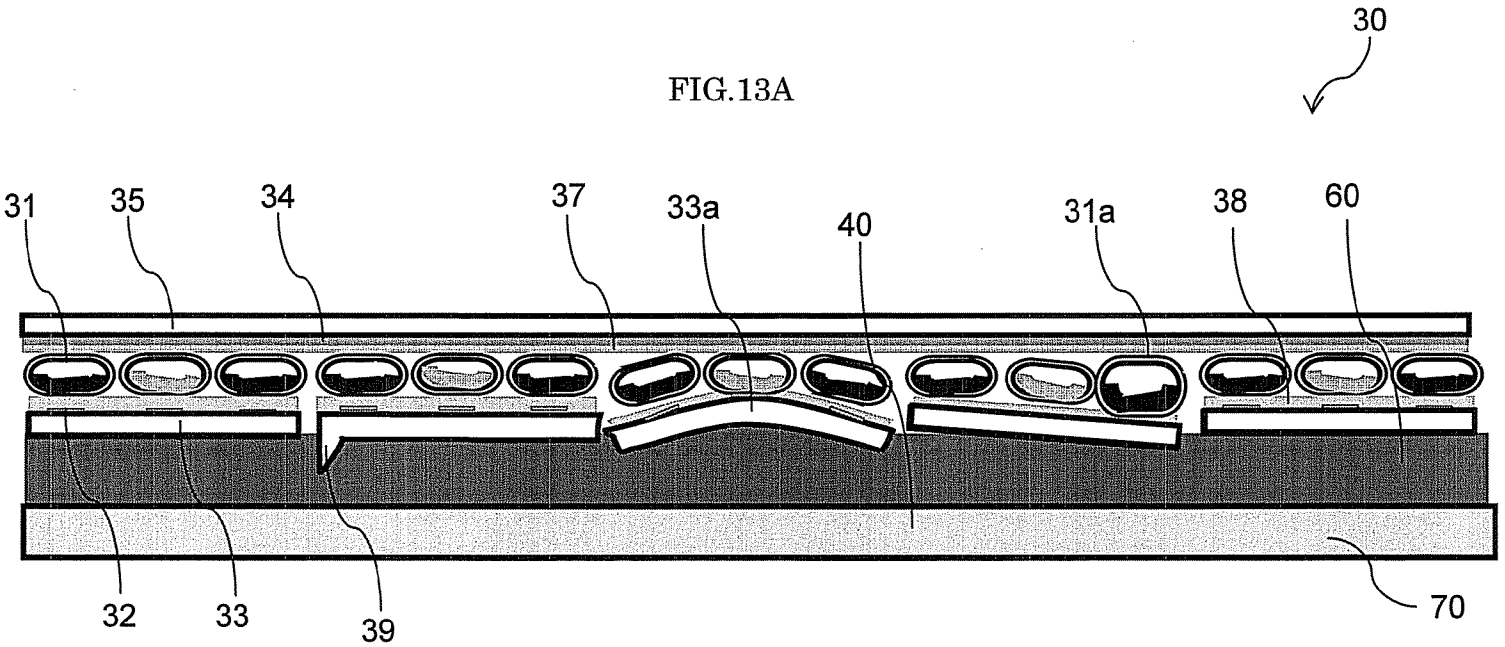
FIG. 13 is a sectional view, orthogonal to the plasma tubes, which shows the schematic configuration of the plasma tube array-type display sub-module according to a fourth embodiment of the present invention.
Figure 13B:
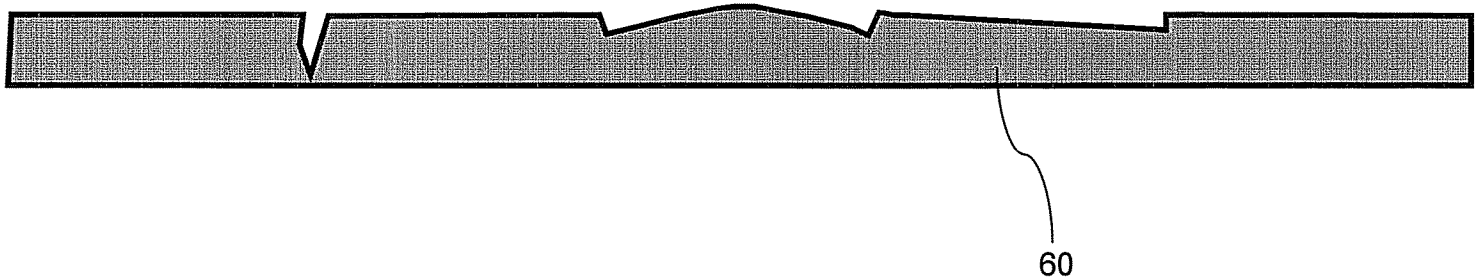

In view of this, in the fourth embodiment, the intermediate layer 60 of the address electrode support sheets 33, 33, . . . on the back side of the plasma tube array is made of a gel-like material with the noise absorbing function, whereby a noise absorbing layer is formed. Further, a hard back support plate 70 that supports the intermediate layer 60 is made of a material with a noise reflecting function, whereby a noise reflection layer is formed. FIG. 13 is a sectional view, orthogonal to the plasma tubes 31, 31, . . . , which shows the schematic configuration of the plasma tube array-type display sub-module according to the fourth embodiment of the present invention.

As shown in FIG. 13, the gel-like intermediate layer 60 is formed on the back side of the address electrode support sheets 33, 33, . . . as the noise absorbing layer. The intermediate layer 60 is interposed between the hard back support plate 70 and the address electrode support sheets 33, 33, . . . , wherein the intermediate layer 60 deforms along the surface shape of the address electrode support sheets 33, 33, . . . on the back side. The hard back support plate 70 functions as the noise reflection layer.

By virtue of this structure, when the abnormal noise is generated from the surface of the plasma tube array, a certain amount of noise energy is absorbed by the intermediate layer 60, whereas a certain amount of noise is reflected toward the plasma tube array side by the hard back support plate 70. Next, a certain amount of noise energy of the noise reflected by the hard back support plate 70 is absorbed again by the intermediate layer 60, whereby the abnormal noise generated from the surface of the plasma tube array can be reduced.

It is preferable that a soft material with a Young's modulus of 10 to 200 KPa, for example, is used for the intermediate layer 60 which functions as the noise absorbing layer. Examples may include a material that has light transparency, such as silicone gel, polyethylene gel, acrylic gel, urethane gel, acrylic urethane gel, butadiene gel, isoprene gel, butyl gel, styrene butadiene gel, ethylene-vinyl acetate copolymer gel, ethylene-propylene-diene terpolymer gel, fluorine gel, and the like.

It is preferable that a hard material with a Young's modulus of 1000 to 4000 KPa, for example, is used for the back support plate 70 which functions as the noise reflection layer. Examples may include a material that has light transparency and can be used for a polymer film, such as polyethylene terephthalate, polyether sulfone, polystyrene, polyethylene naphthalate, polyarylate, polyether ether ketone, polycarbonate, polyethylene, polypropylene, polyamide such as nylon 6 and the like, polyimide, cellulose resin such as triacetyl cellulose and the like, polyurethane, fluorine resin such as polytetrafluoroethylene and the like, vinyl compound such as polyvinyl chloride and the like, polyacrylic acid, polyacrylic acid ester, polyacrylonitrile, addition polymer such as vinyl compound and the like, polymethacrylate, polymethacrylic acid ester, vinylidene compound such as polyvinylidene chloride and the like, vinylidene fluoride/trifluoroethylene copolymer, vinyl compound or fluorine compound copolymer such as ethylene/vinyl acetate copolymer and the like, polyether such as polyethylene oxide and the like, epoxy resin, polyvinyl alcohol, polyvinyl butyral, or the like.

According to the fourth embodiment, the intermediate layer 60 functions as the noise absorbing layer, which can effectively avoid the specific noise generated from the surface of the plasma tube array leaking from the front side of the display device. Accordingly, the display device that does not give uncomfortable feeling to a person seeing an image can be provided.

The fourth embodiment is described on the basis of the configuration in the first embodiment. It is needless to say that the same effect can be obtained even with the configurations in the second and third embodiments if the intermediate layer 60 is made of a gel-like material.

Various modifications are possible without departing from the scope of the present invention. It is needless to say that, for example, the material for the intermediate layer 60, the adhesive layers 37 and 38 is not limited to the above-mentioned materials, but can be selected according to how much the intermediate layer 60 is filled.

What is claimed is:

1. A plasma tube array-type display sub-module comprising:

an address electrode support sheet having a plurality of address electrodes formed thereon;

a display electrode support sheet having a plurality of display electrodes formed thereon; and a plurality of plasma tubes each filled with a discharge gas, arranged in parallel and held between the address electrode support sheet and the display electrode support sheet as a plasma tube array, wherein the plasma tube array is fixed to a sub-module frame through an intermediate layer which can deform along the surface shape of the address electrode support sheet on the back side.

2. The plasma tube array-type display sub-module according to claim 1, further comprising:

an adhesive layer, which is a solvent type adhesive layer and bonds the address electrode support sheet to the plasma tubes in a condition in which the adhesive layer is not in contact with the intermediate layer.

3. The plasma tube array-type display sub-module according to claim 2, wherein a solvent type acrylic resin is used for both the adhesive layer and the intermediate layer.

4. The plasma tube array-type display sub-module according to claim 1, wherein the intermediate layer is formed so as to be in contact with a first adhesive layer, which bonds the address electrode support sheet that is divided by the plurality of plasma tubes and the plasma tubes, and a second adhesive layer, which bonds the display electrode support sheet and the plasma tubes, through a gap between the adjacent address electrode support sheets and a clearance between the adjacent plasma tubes.

5. The plasma tube array-type display sub-module according to claim 1, wherein the intermediate layer is formed so as to be in contact with a first adhesive layer, which bonds the address electrode support sheet that is divided by the plurality of plasma tubes and the plasma tubes, through a gap between the adjacent address electrode support sheets and a clearance between the adjacent plasma tubes, and a second adhesive layer, which bonds the display electrode support sheet and the plasma tubes, bonds the display electrode support sheet and the plasma tubes in a condition in which the second adhesive layer is not in contact with the intermediate layer.

6. The plasma tube array-type display sub-module according to claim 5, wherein a solvent type acrylic resin is used for both the first adhesive layer and the second adhesive layer.

7. A display device comprising the plurality of plasma tube array-type display sub-modules according to claim 1 joined to one another.

8. A display device comprising:

a plurality of plasma tubes each filled with a discharge gas;

an address electrode support sheet on the back side having a plurality of address electrodes formed along a longitudinal direction of the plasma tubes;

a display electrode support sheet on the front side having a plurality of display electrodes extending in the direction of crossing all the plasma tubes; and the plurality of plasma tubes arranged in parallel and held between the address electrode support sheet and the display electrode support sheet, wherein a hard back support plate is provided through an intermediate layer having a flexibility to deform along the surface shape of the address electrode support sheet on the back side.

9. The display device according to claim 8, wherein the intermediate layer is made of a gel-like material with a Young's modulus of not less than 10 KPa and not more than 200 KPa.

10. The display device according to claim 8, wherein the back support plate is made of a hard plastic with a Young's modulus of not less than 1000 KPa and not more than 4000 KPa.

11. The display device according to claim 9, wherein the back support plate is made of a hard plastic with a Young's modulus of not less than 1000 KPa and not more than 4000 KPa.

12. A display device comprising:

a plurality of plasma tubes each filled with a discharge gas;

an address electrode support sheet on the back side having a plurality of address electrodes formed along a longitudinal direction of the plasma tubes;

a display electrode support sheet on the front side having a plurality of display electrodes extending in the direction of crossing all the plasma tubes thereon; and the plurality of plasma tubes arranged in parallel and held between the address electrode support sheet and the display electrode support sheet; wherein a hard back support plate with a noise reflecting function is provided through an intermediate member, having a noise absorbing function and a roughness absorbing function effected by deforming along the surface shape of the address electrode support sheet on the back side.

13. The display device according to claim 12, wherein the intermediate member is made of a gel-like material and the back support plate is made of a hard plastic.

* * * * *